US006534251B1

(12) United States Patent
Maeda et al.

(10) Patent No.: US 6,534,251 B1
(45) Date of Patent: Mar. 18, 2003

(54) SILVER SALT PHOTOTHERMOGRAPHIC DRY IMAGING MATERIAL AND IMAGE RECORDING METHOD THEREOF

(75) Inventors: Keiko Maeda, Hino (JP); Tetsuo Shima, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/092,995

(22) Filed: Mar. 6, 2002

(30) Foreign Application Priority Data

Mar. 13, 2001 (JP) ..... 2001-070242

(51) Int. Cl.[7] ..... G03C 5/16

(52) U.S. Cl. ..... 430/350; 430/531; 430/619; 430/620; 430/945

(58) Field of Search ..... 430/619, 531, 430/350, 620, 567, 945

(56) References Cited

U.S. PATENT DOCUMENTS 6,150,084 A * 11/2000 Itoh et al. ..... 430/610

FOREIGN PATENT DOCUMENTS

EP 0803764 * 10/1997 ..... G03C/1/498

* cited by examiner

*Primary Examiner*—Thorl Chea
(74) *Attorney, Agent, or Firm*—Bierman, Muserlian and Lucas

(57) ABSTRACT

A silver salt photothermographic dry imaging material comprising a support having thereon a photosensitive layer comprising silver aliphatic carboxylate grains and photosensitive silver halide grains, a reducing agent for silver ions, a binder and a cross-linking agent, wherein the photothermographic material has a silver coverage of 1.0 to 1.7 $g/m^2$; the photosensitive silver halide grains have a mean grain size of 0.03 to 0.055 $\mu$m and a degree of grain size dispersity of not more than 30%; after the dry imaging material has been subjected to photothermographic processing at a temperature of 100 to 200° C. for 5 to 50 seconds, the photosensitive layer exhibits a thermal transition temperature of 46 to 200° C.

11 Claims, No Drawings

SILVER SALT PHOTOTHERMOGRAPHIC DRY IMAGING MATERIAL AND IMAGE RECORDING METHOD THEREOF

FIELD OF THE INVENTION

The present invention relates to a silver salt photothermographic dry image forming material and an image recording method thereof.

BACKGROUND OF THE INVENTION

Heretofore, in the medical diagnosis and printing plate making fields, effluent resulting from wet type processing for image forming materials has become problematic in terms of workability, and in recent years, from the viewpoint of environmental protection as well as space saving, a decrease in processing effluent has been highly demanded.

Accordingly, it has been requested to develop a technology, employing photothermographic materials, for use in photographic techniques in which efficient exposure can be performed utilizing laser imagers and image setters, and can form clear, high resolution black-and-white images.

Silver salt photothermographic dry imaging materials (hereinafter, also referred to simply as photosensitive materials), which are comprised of organic silver salts, photosensitive silver halides and reducing agents on a support, as a technique to meet said demand, are disclosed, for example, in U.S. Pat. Nos. 3,152,904 and 3,487,075 by D. Morgan and B. Shely, and "Dry Silver Photographic Materials" (Handbook of Imaging Materials, Marcel Dekker Inc., page 48, 1991) edited by D. H. Klosterboer. Since no solution-form processing chemicals are used in the silver salt photothermographic dry imaging material, users can be provided with a system which is simpler and not deteriorating environment.

These silver salt photothermographic dry imaging materials are characterized in that photosensitive silver halide grains provided in the photosensitive layer are utilized as a light sensor, and organic silver salts are utilized as the silver ion supplying source, so that images are formed by conducting heat development commonly at 80 to 140° C., employing incorporated reducing agents, without the requirement of fixing the image.

However, since the silver salt photothermographic dry imaging material is comprised of organic silver salts, photosensitive silver halide grains and reducing agents, fogging tends to result during storage prior to the heat development. Further, problems occur in which image quality, such as silver image tone, is varied easily by formation of metal silver due to heat and light, when images are stored for a long period of time, because the whole or a part of silver halides, organic silver salts and reducing agents, etc. remain together even after the heat development, due to that the photosensitive material is subjected to only heat development generally at 80 to 250° C. without being fixed after exposure.

Techniques to over come these problems are disclosed in documents such as JP-A 6-208192 (hereinafter, JP-A refers to an unexamined and published Japanese Patent Application), 8-267934, U.S. Pat. No. 5,714,311, and the references cited therein. However, even though these disclosed techniques exhibit some desirable effects, they are not sufficient to satisfy market demand.

On the other hand, further enhancement of image quality has been demanded as a so-called everlasting matter to be solved in silver salt photothermographic dry imaging materials. Specifically, in the field of medical diagnostic imaging, higher image quality which enables more accurate diagnosis has been demanded.

Accordingly, the invention has been applied in view of the foregoing problems, and the object of the invention is to provide a silver salt photothermographic dry imaging material, which exhibits enhanced sensitivity, minimized fogging and superior raw stock stability as well as superior silver image lasting quality after heat development, and an image recording method using the same.

SUMMARY OF THE INVENTION

The object of the invention has been achieved by the following embodiments.

(1) A silver salt photothermographic dry imaging material comprising a support having thereon a photosensitive layer comprising silver aliphatic carboxylate grains and photosensitive silver halide grains, a reducing agent for silver ions, a binder and a cross-linking agent, wherein the. photothermographic material has a silver coverage of 1.0 to 1.7 g/m$^2$; the photosensitive silver halide grains have a mean grain size of 0.03 to 0.055 $\mu$m and a degree of grain size dispersity of not more than 30%; after the dry imaging material has been subjected to photothermographic processing at a temperature of 100 to 200° C. for 5 to 50 seconds, the photosensitive layer exhibits a thermal transition temperature of 46 to 200° C.

(2) A silver salt photothermographic dry imaging material comprising a support having thereon a photosensitive layer comprising silver aliphatic carboxylate grains and photosensitive silver halide grains, a reducing agent for silver ions, a binder and a cross-linking agent, wherein the photothermographic material has a silver coverage of 1.0 to 1.7 g/m$^2$; the silver aliphatic carboxylate grains have a mean equivalent circle diameter of 0.05 to 0.8 $\mu$m and a mean grain thickness of 0.005 to 0.07 $\mu$m; and the photosensitive layer, after being subjected to photothermographic processing at a temperature of 100 to 200° C. for 5 to 50 seconds, exhibits a thermal transition temperature of 46 to 200° C.

(3) The silver salt photothermographic dry imaging material of item 1, wherein the silver aliphatic carboxylate grains are formed in the presence of a compound capable of functioning as a crystal growth retarder or a dispersant for the silver aliphatic carboxylate grains.

(4) The silver salt photothermographic dry imaging material of item 1, wherein the binder exhibits a glass transition temperature (Tg) of 70 to 105° C.

(5) The silver salt photothermographic dry imaging material of item 3, wherein the compound capable of functioning as a crystal growth retarder or a dispersant is an alcohol having not more than 10 carbon atoms.

(6) The silver salt photothermographic dry imaging material of item 3, wherein the compound capable of functioning as a crystal growth retarder or a dispersant is a branched aliphatic carboxilic acid or an unsaturated aliphatic carboxilic acid.

(7) The silver salt photothermographic dry imaging material of item 3, wherein the compound capable of functioning as a crystal growth retarder or a dispersant is gelatin or polyvinyl alcohol.

(8) The silver salt photothermographic dry imaging material of item 1, wherein a silver saving agent is incorporated in the photosensitive layer or a non-photosensitive layer.

(9) The silver salt photothermographic dry imaging material of item 1, wherein the photosensitive layer comprises at least two layers.

(10) The silver salt photothermographic dry imaging material of item 1, wherein the photothermographic material, after subjected to thermal development, has a hue angle $h_{ab}$ of $180° < h_{ab} < 270°$.

(11) An image recording method of the silver salt photothermographic dry imaging material of item 1, which comprises the steps of:

(a) exposing the photothermographic material with a laser light scanning exposure apparatus, in which a scanning laser light is a longitudinal multiple mode;

(b) bringing the laser exposed photothermographic material into proximity with a heat source;

(c) thermally developing the laser exposed photothermographic material; and (d) removing the thermally developed photothermographic material from the heat source.

DETAILED DESCRIPTION OF THE INVENTION

The invention will now be detailed below.

The photosensitive silver halide grains (also referred to simply as silver halide grains) in the invention will now be explained. The photosensitive silver halide grains in the invention means the silver halide grains, which essentially are capable of absorbing light as an intrinsic characteristic of a silver halide crystal or artificially capable of absorbing visible light or infrared light by physicochemical methods and are treated and prepared so as to cause physicochemical change in the interior and/or at the surface of said silver halide crystal can occur when the crystal absorbs any light within the wavelengths region from ultraviolet to infrared.

The silver halide grains themselves employed in the invention can be prepared as a silver halide grain emulsion by the methods, as described in P. Glafkides, "Chimie et Physique Photographique" (published by Paul Montel Co., 1967); G. F. Duffin, "Photographic Emulsion Chemistry" (published by The Focal Press, 1966); and V. L. Zelikman et al., "Making and Coating Photographic Emulsion" (published by The Focal Press, 1964). Namely, any of the acid method, neutral method, or ammonia method may be utilized. Further, water-soluble silver salts may be allowed to react with water-soluble halide salts employing any of the single-jet method, double-jet method, or the combination thereof, however, a so-called controlled double-jet method, in which silver halide grains are prepared while controlling the precipitation conditions, is preferred among the above methods. Halide compositions are not particularly limited and include any of silver chloride, silver chlorobromide, silver chloroiodobromide, silver bromide, silver iodobromide, or silver iodide.

The grain formation is generally divided into two steps, a formation of seed silver halide grains (nucleation) and a growth of the grains, and either of a method in which these steps are continuously performed and a method in which these steps are separately performed can be employed. The controlled double-jet method is preferred because it can control such as the shape and the size of grains by controlling the precipitation conditions such as pAg and pH. For example, in cases where the nucleation and the grain growth are separately performed, a water-soluble silver salt and a water-soluble halide salt are homogeneously and rapidly mixed in an aqueous gelatin solution to form nucleus grains or seed grains(nucleation process), followed by the grain growth process, in which the grains are grown by supplying a water-soluble silver salt and a water-soluble halide salt under the controlled pAg and pH. The desired silver halide emulsion can be obtained by removing unnecessary salts and the like by a desalting process well known in the art such as a noodle washing method, flocculation method, ultrafiltration method and electrodialysis method.

The silver halide grains according to the invention preferably have a smaller mean grain size in order to minimize milky-whiteness and (yellowish) coloring after the image formation as well as to produce excellent image quality, and preferably have a mean grain size of 0.035 to 0.055 μm, when grains smaller than 0.02 μm are excluded from the measurement. The grain size, herein, refers to the edge length of a silver halide grain in the case of a so-called regular crystal grain, such as a cubic or octahedral grain. Further, in the case of a tabular grain, it refers to a diameter of a circle image having the same area as the projected area of the main surface.

The silver halide grains in the invention are preferably monodisperse. "Monodisperse" described herein refers to a condition in which a variation coefficient of grain size calculated by the following equation is not more than 30%. It is preferably not more than 20%, and more preferably not more than 15%.

$$\text{Variation coefficient of grain size (\%)} = \{(\text{standard deviation of grain size})/(\text{mean grain size})\} \times 100$$

The shape of the silver halide grains include such as cubic, octahedral, tetradecahedral, tabular, spherical, rod-shaped and potato-shaped, and specifically preferable among them are cubic, octahedral, tetradecahedral and tabular.

When tabular silver halide grains are employed, the aspect ratio is preferably not less than 1.5 and not more than 100, and more preferably not less than 2 and not more than 50. These are described in such as U.S. Pat. Nos. 5,264,337, 5,314,798 and 5,320,958, and the aimed tabular grains can be obtained easily. Further, silver halide grains having rounded corners thereof can also preferably be employed.

The crystal habit of the silver halide outer surface is not specifically limited, however, when a spectral sensitizer has a crystal habit selective property in the adsorption reaction of a sensitizing dye onto the silver halide grains, it is preferred to employ the silver halide grains containing the grain having the crystal habit suitable to the selectivity at a relatively higher proportion. For example, when a spectral sensitizer which absorbs selectively on the Miller index [100] surface of a crystal is employed, it is preferred that the proportion of [100] surface in crystal's outside surfaces is high, the ratio is preferably not less than 50%, more preferably not less than 70%, and specifically preferably not less than 80%. The proportion of the Miller index [100] can be determined according to T. Tani, J. Imaging Sci., 29, 165 (1985).

The silver halide grains in the invention is preferably prepared by use of low molecular weight gelatin having a mean molecular weight of not more than 50,000 at the precipitation process, specifically at the nucleation process of silver halide grains. The low molecular weight gelatin has a mean molecular weight of not more than 50,000, preferably of 2,000 to 40,000, and more preferably of 5,000 to 25,000. The mean molecular weight of gelatin can be measured by means of gel filtration chromatography. The low molecular weight gelatin can be obtained such as, by an enzyme decomposition in which an enzyme is added to an aqueous solution of a gelatin generally used and having a mean molecular weight of approximately 100,000, by an hydrolysis in which the solution is heated with an addition of an acid or alkali, by a thermal decomposition by heating under atmospheric pressure or increased pressure, by a decomposition with an ultrasonic irradiation, or by the combinations thereof.

The concentration of a dispersing medium at the nucleation is preferably not more than 5% by weight, and it is effective to perform the nucleation at a low concentration of 0.05 to 3.0% by weight.

The silver halide grains used in the invention is preferably incorporated with compounds represented by the following formula, at the precipitation of the grains: Formula:

$$YO(CH_2CH_2O)_m(CH(CH_3)CH_2O)_p(CH_2CH_2O)_nY$$

where Y represents a hydrogen atom, —$SO_3M$ or —CO—B—COOM; in which M represents a hydrogen atom, an alkali-metal atom, an ammonium group or an ammonium group substituted by an alkyl group having a carbon number of not more than 5 and B represents a chain or cyclic group forming an organic dibasic acid; and m and n each represents 0 to 50; and p represents 1 to 100.

The polyethylene oxide compounds represented by the above formula have been employed as defoaming agents against the remarked foaming when the starting materials for the emulsion are transported or stirred in the processes of the preparation of silver halide photographic photosensitive materials such as a preparation process of an aqueous gelatin solution, an addition process of an water-soluble halide and an water-soluble silver salt to the gelatin solution, and a coating process of the emulsion on a support, and the technique to utilize them as deforming agents is disclosed such as in JP-A 44-9497. The polyethylene oxide compounds represented by the above formula also function as a defoaming agent in the nucleation stage.

The compounds represented by the above formula are preferably employed at not more than 1% by weight of silver, and more preferably at 0.01 to 0.1% by weight, based on silver.

The polyethylene oxide compounds represented by the above formula are preferably present at the nucleation process and are preferably added in advance in the dispersion medium before the nucleation, however, they can also be added during the nucleation or in the silver salt solution or in the halide solution which is used for the nucleation. They are preferably employed by being added at 0.01 to 2.0% by weight in the aqueous halide solution or in the both aqueous solutions. The compounds are preferably present during a time range of at least not less than 50% of the nucleation process, and more preferably not less than 70%. The compounds represented by the above formula may be added as powder or by dissolving in a solvent such as methanol.

The temperature in the nucleation process is 5 to 60° C., and preferably 15 to 50° C. The temperature may be a constant, may follow a rising temperature pattern (for example, a pattern in which the temperature at the start of the nucleation is 25° C., the temperature is gradually raised in the nucleation and the temperature at the end of the nucleation is 40° C.,) or may follow the opposite pattern, and they are preferably controlled within the aforementioned temperature range.

The concentrations of the aqueous silver salt solution and the aqueous halide solution are preferably not more than 3.5 normal, and further preferably a low concentration range of 0.01 to 2.5 normal. The addition speed of the silver ion at the nucleation is preferably $1.5\times10^{-3}$ to $3\times10^{-1}$ mol/min, and more preferably $3.0\times10^{-3}$ to $8.0\times10^{-2}$ mol/min.

The pH at the nucleation process can be set within a range of 1.7 to 10, and preferably 2 to 6 because the grain size distribution of the nuclei formed is broadened at pH of an alkaline side. The pBr at the nucleation process is approximately 0.05 to 3.0, preferably 1.0 to 2.5 and more preferably 1.5 to 2.0.

The silver halide grains according to the invention may be added in the photosensitive layer by any method, and are preferably distributed neighboring to the reducible silver source (silver aliphatic carboxylates).

The silver halide grains according to the invention are preferably prepared in advance and added to the solution for preparing the silver aliphatic carboxylates, because the preparation processes of the silver halide and the silver aliphatic carboxylates can be separately operated, which is preferred in respect to the control of the preparation process, however, the silver halide grains can also be formed almost simultaneously with the formation of silver aliphatic carboxylate grains, by allowing a halogen component such as a halide ion to be concurrently present with a silver aliphatic carboxylate forming component, followed by injection of a silver ion thereto as described in British Patent No. 1,447,454. Further, the silver halide grains can be prepared by the conversion of the silver aliphatic carboxylates by acting a halogen containing compound with the silver aliphatic carboxylates. That is, a part of the silver aliphatic carboxylates can be converted to a photosensitive silver halide by causing a silver halide forming component to act onto a solution or dispersion of silver aliphatic carboxylates or the sheet material containing silver aliphatic carboxylates, which are prepared in advance.

The silver halide forming components include inorganic halogen compounds, onium halides, hydrocarbon halogenides, N-halogen compounds and other halogen containing compounds, and the concrete examples include metal halogenides detailed in U.S. Pat. Nos. 4,009,039, 3,457,075, 4,003,749, British Patent No. 1,498,956, JP-A 53-27027 and 53-25420; inorganic halogenides such as ammonium halogenides; onium halides such as trimethylphenyl ammoniumbromide, cetylethyldimethyl ammoniumbromide and trimethylbenzyl ammoniumbromide; hydrocarbon halogenides such as iodoform, bromoform, carbon tetrachloride, 2-bromo-2-methyl propane; N-halogen compounds such as N-bromosuccinimide, N-bromophthalimide and N-bromoacetamide; in addition, such as triphenylmethyl chloride, triphenylmethyl bromide, 2-bromoacetate, 2-bromoethanol and dichlorobenzophenone. Thus, the silver halide can be prepared by converting a part or the total of silver in the organic silver salt to silver halide by the reaction between an organic silver salt and a silver ion. The silver halide grains prepared by the conversion of a part of the silver aliphatic carboxylates can be used in combination with the silver halide separately prepared.

These silver halide grains, including those separately prepared and those prepared by converting the silver aliphatic carboxylates, are employed in an amount of 0.001 to 0.7 mol, and preferably 0.03 to 0.5 mol, based on 1 mol of the silver aliphatic carboxylates.

The silver halide employed in the invention preferably contains an ion of transition metals belonging to 6th to 11th groups of the periodic table. Preferred examples of the metals described above include W, Fe, Co, Ni, Cu, Ru, Rh, Pd, Re, Os, Ir, Pt and Au. These are used alone or in combination. These metal ions can be incorporated into the silver halide as a metal salt thereof as it is, and also be incorporated as a metal complex or a complex ion thereof. The preferred content is $1\times10^{-9}$ to $1\times10^{-2}$ mol, and more preferred is $1\times10^{-8}$ to $1\times10^{-4}$ mol, based on 1 mol of silver. In the invention, the transition metal complexes or the complex ions are preferably represented by the following formula:

$$[ML_6]^m \qquad \text{Formula:}$$

where M represents a transition metal selected from the elements of 6th to 11th groups of the periodic table, L represents a ligand and m represents 0, -, 2-, 3- or 4-. Specific examples of ligands represented by L include such as halogen ions (a fluorine ion, chlorine ion, bromine ion and iodine ion), cyanide, cyanato, thicyanato, selenosyanato, tellurocyanato, ligands of azido and aquo, nitrocyl, thionitrocil, etc. Of these, aquo, nitrocyl and thionitrocyl are preferred. When an aquo ligand is present, it is preferable that one or two of the ligands be subjected to coordination. Plural Ls may be the same or different.

The compounds providing these metal ions or complex ions are preferably added during the precipitation of the silver halide grains so as to be incorporated in the silver halide grains. They may be added at any stage of preparation of the silver halide grains, including nucleation, growth, physical ripening or chemical ripening, preferably at the stage of nucleation, growth or physical ripening, furthermore preferably at the stage of nucleation or growth, and most preferably at the stage of nucleation. They may be added in a few times dividing in fractions, and can be incorporated homogeneously in the silver halide grain, or with a distribution in the grain as described such as in JP-A 63-26603, 2-306236, 3-167545, 4-76534, 6-110146 and 5-273683.

These metal compounds can be added by being dissolved in water or suitable organic solvents (for example, alcohols, ethers, glycols, ketones, esters and amides): for example, by a method in which an aqueous solution of the powdered metal compound or that of the metal compound dissolved together with sodium chloride (NaCl) and potassium chloride (KCl) is previously added into a water-soluble silver salt solution or into a water-soluble halide solution; by a method in which the metal compounds are added as the third solution when the silver salt solution and halide solution are mixed to prepare the silver halide grains through triple-jet precipitation; by a method in which a required amount of an aqueous solution of the metal compounds is added into the reaction vessel during the precipitation of grains; or by a method in which another silver halide grains previously doped with the metal ion or complex ion is added and dissolved during the preparation of the silver halide grains. Specifically preferable is the method in which an aqueous solution of the powdered metal compound or that of the metal compound dissolved together with sodium chloride (NaCl) and potassium chloride (KCl) is added into the water-soluble halide solution. When the metal ion is incorporated in the vicinity of the surface of the grain, a required amount of an aqueous solution of metal compounds can also be added into the reaction vessel immediately after completion of precipitation of grains, during or at the finish of physical ripening, or during chemical ripening.

The photosensitive silver halide grains separately prepared can be desalted by commonly known washing methods, such as noodle washing, flocculation method, etc., however they may also be used without being desalted.

The silver aliphatic carboxylate in the invention is a reducible silver sources, and are preferably a silver salt of an aliphatic carboxilic acid having a carbon atoms of 10 to 30, preferably 15 to 25. The preferable examples of the silver salts include the following:

Silver salts of gallic acid, oxalic acid, behenic acid, stealic acid, arachidic acid, palmitic acid, lauric acid, etc. Preferable silver salts among these include silver behenate, silver arachidinate and silver stearate. Further, in the invention, it is preferred that two or more silver aliphatic carboxylates are mixed in respect to enhancing the developability and forming silver images of high density and high contrast, and it is preferably prepared by mixing a mixture of two or more kinds of aliphatic carboxylic acids with a silver ion solution.

The silver aliphatic carboxylate compounds are obtained by mixing a water-soluble silver salt solution and a compound which forms a complex with silver, and are preferably used for the preparation thereof, methods such as a normal precipitation, reverse-precipitation, double-jet precipitation and controlled double-jet method as described in JP-A 9-127643. For example, the silver aliphatic carboxylate crystals are prepared, by preparing an organic alkali-metal salt soap (such as sodium behenate and sodium arachidinate) which are formed by adding an alkali metal salt (such as sodium hydroxide and potassium hydroxide) to an organic acid, followed by adding the aforementioned soap and silver nitrate by the controlled double-jet method. In this case, silver halide grains may concurrently be present in a mixture.

In the silver aliphatic carboxylates according to the invention, it is preferred that the mean circle equivalent diameter is not less than 0.05 $\mu$m and not more than 0.8 $\mu$m, and the mean thickness is not less than 0.005 $\mu$m and not more than 0.07 $\mu$m; and specifically preferred that the mean circle equivalent diameter is not less than 0.2 $\mu$m and not more than 0.5 $\mu$m and the mean thickness is not less than 0.01 $\mu$m and not more than 0.05 $\mu$m. Essentially, the silver aliphatic carboxylates according to the invention are tabular.

When the mean circle equivalent diameter is not more than 0.05 $\mu$m, the transparency is superior but the image retention quality is poor; and when the mean grain size is not less than 0.8 $\mu$m, the haze is extreme. When the mean thickness is not more than 0.005 $\mu$m, the surface area of the grain becomes large, so that silver ion supply at the development is performed vigorously causing a large quantity of silver ion being remained in the film layer without being consumed by silver images especially in the low density area, which markedly deteriorates the image retention quality. When the mean thickness is not less than 0.07 $\mu$m, the surface area of the grain becomes small, so that, although the image stability is improved, the silver ion supply at the development is slow causing inhomogeneities of the shape of developed silver especially in a high density area, which is apt to lower the maximum density.

The mean equivalent circular diameter is determined as follows. Dispersed silver aliphatic carboxylate was diluted, dispersed onto a grid fitted with a carbon supporting film, and imaged at a direct magnification of 5,000, employing a transmission-type electron microscope (2000FX Type, manufactured by Nippon Denshi). The grain diameter (being the circle equivalent diameter) of at least 300 grains was determined utilizing suitable image processing software upon reading negative images as digital images employing a scanner. Subsequently, a mean grain diameter was calculated.

The mean thickness was calculated according to the following method which utilizes a TEM (transmission-type electron microscope).

Initially, the photosensitive layer, coated onto the support, is adhered onto a suitable holder employing an adhesive. Subsequently, employing a diamond knife, 0.1 to 0.2 $\mu$m ultra-thin slices are cut in perpendicular direction against the support. The prepared ultra-thin slice is held employing a copper mesh, and is transferred onto a carbon film which has been made hydrophilic by glow discharge. Thereafter, while cooled at −130° C. or lower employing liquid nitrogen, the bright field image is observed by a factor of 5,000 to 40,000, employing a TEM, and the image are quickly recorded employing film, an image plate or a CCD camera. During the operation, it is preferable that the field of vision be suitably determined so as to select a part of the slice having neither tears nor looseness.

The carbon film, which is supported with a very thin organic film such as collodion or Formvar, is preferably employed. Further, more preferably, the carbon film is obtained in such a manner that the film is formed on a rock salt substrate which is removed through dissolution, or a film comprised of only carbon is obtained by removing the organic film utilizing organic solvents, or by ion etching. The acceleration voltage of TEM is preferably from 80 to 400 kV, but is most preferably from 80 to 200 kV.

Further, for the detail of electron microscope observation techniques and sample preparation techniques, "Observation Techniques of Electron Microscopy in Medical Science and Biology", edited by Kanto-branch of Japanese Society of Electron Microscopy (Maruzen) and "Biological Sample Preparation Methods of Electron Microscopy", edited by Kanto-branch of Japanese Society of Electron Microscopy (Maruzen) can be referred to respectively.

It is preferable that the TEM image recorded on a suitable medium is subjected to image processing, utilizing a computer upon decomposing one sheet of the image into at least 1,024×1,024 pixels, or preferably at least 2,048×2,048 pixels. In order to conduct desired image processing, it is preferable that an analogue image recorded on a film is converted to a digital image, employing a scanner and if desired, is subjected to shading correction and contrast-edge enhancement. Thereafter, a histogram is prepared and positions corresponding to silver aliphatic calboxylate grains are extracted employing binary processing.

The thickness of at least 300 silver aliphatic carboxylate grains, extracted above, is measured employing suitable software, whereby the mean thickness value is obtained.

The method to prepare silver aliphatic carboxylate grains of the aforementioned shape is not particularly limited, and it is effective, such as to keep a good mixing state at the formation of the alkali-metal salt soap of an organic acid and/or at the addition of silver nitrate to the soap, and to optimize the ratio of an organic acid to the soap and the ratio of silver nitrate which reacts to the soap.

It is preferable that if desired, after tabular silver aliphatic carboxylate grains (which refer to silver aliphatic carboxylate grains having a mean circle equivalent diameter of not less than 0.05 $\mu$m and not more than 0.8 $\mu$m, and a mean thickness of not less than 0.005 $\mu$m and not more than 0.07 $\mu$m) according to the invention are preliminarily dispersed together with binders and surface active agents, the grains are dispersed and crushed employing a media homogenizer or a high pressure homogenizer. In order to carry out the preliminary dispersion, it is possible to employ common stirrer such as anchor type and a propeller type, a high speed rotation centrifugal radial type stirrer (being a dissolver), and a high speed rotation shearing type stirrer (being a homomixer).

Further, employed as the media type homogenizer may be rotation mills such as a ball mill, a planet ball mill and a vibration ball mill, medium stirring mills such as a bead mill, an attritor, and others such as a basket mill. Employed as high pressure homogenizers may be employed those of several types such as a wall and plug colliding type, a type in which liquid is separated into a plurality of flows which are made to collide with each other at a high-speed, and type in which liquid is passed through a narrow orifices.

Preferably employed as ceramics used as ceramic beads used during the media dispersion are preferably, for example, $Al_2O_3$, $BaTiO_3$, $SrTiO_3$, MgO, ZrO, BeO, $Cr_2O_3$, $SiO_2$, $SiO_2$—$Al_2O_3$, $Cr_2O_3$—MgO, MgO—CaO, MgO—C, MgO—$Al_2O_3$ (spinel), SiC, $TiO_2$, $K_2O$, $Na_2O$, BaO, PbO, $B_2O_3$, $SrTiO_3$ (strontium titnate), $BeAl_2O_4$, $Y_3Al_5O_{12}$; $ZrO_2$—$Y_2O_3$ (cubic zirconia), 3BeO—$Al_2O_3$—$6SiO_2$ (synthetic emerald), C (synthetic diamond), $Si_2O$—$nH_2O$, silicon nitride, yttrium-stabilized zirconia, zirconia-strengthened alumina. Since minimal impurities are formed due to friction of beads with a homogenizer during dispersion, yttrium-stabilized zirconia and zirconia-strengthened alumina (these zirconia containing ceramics are abbreviated as zirconia hereunder) are most preferably employed.

In devices employed to disperse tabular silver aliphatic carboxylate grains according to the invention, preferably employed as materials of members, being contacted by the silver aliphatic carboxylate grains, are ceramics such as zirconia, alumina, silicon nitride and boron nitride, or diamond. of these, zirconia is preferably employed. When the dispersion is carried out, it is preferable that binders are added in an amount of 0.1 to 10 percent by weight of the silver aliphatic carboxylate and the temperature of the liquid dose not exceed 45° C. during the preliminary dispersion to the main dispersion. Further, preferred operation conditions of the main dispersion are as follows. For example, when the high pressure homogenizer is employed as the dispersion means, 29.42 Mpa to 98.06 Mpa and at least two operations are listed. Further, when the media homogenizer is employed as the dispersion means, a circumferential speed of 6 to 13 m/sec. is listed as the preferred conditions.

In the invention, the compounds which function as a crystal growth retarder against or a dispersant for silver aliphatic carboxylate grains, refers to the compounds having a function or effect to reduce the grain size and/or increase monodispersity when silver aliphatic carboxylate is prepared in the presence of the compounds compared to when it is prepared in the absence of the compounds, in the preparation process of the silver aliphatic carboxylate grains. Examples include monohydric alcohols having not more than 10 carbon atoms, and preferably secondary alcohols, tertiary alcohols, glycols such as ethylene glycol and propylene glycol, and polyethers such as polyethylene glycol. The preferred addition amount is 10 to 200 weight % of silver aliphatic carboxylate.

On the other hand, branched aliphatic carboxylic acids, such as isoheptanoic acid, isodecanoic acid, isotridecanoic acid, isomyristic acid, isopalmitic acid, isostealic acid, isoarachidic acid, isobehenic acid and isohexacoic acid, including their isomers, are also preferable. In this case, preferable side chains include an alkyl group or an alkenyl group having not more than 4 carbon atoms. Further, unsaturated aliphatic carboxylic acids such as palmitoleic acid, oleic acid, linolic acid, linolenic acid, moroctic acid, eicosenoic acid, arachidonic acid, eicosapentaenoic acid, erucic acid, docosapentaenoic acid, docosahexaenoic acid and selacholenoic acid are listed. The preferable addition amount is 0.5 to 10 mol % of silver aliphatic carboxylate.

Glycocide series such as glucoside, galactoside and fructoside; trehalose type disacchride siries such as trehalose and sucrose; polysaccharide siries such as glycogen, dextrin, dextran and alginic acid; cellosolve series such as mehtyl cellosolve and ethyl cellosolve; water-soluble organic solvents such as sorbitan, solbite, ethyl acetate, methyl acetate and dimethyl formamide; and water-soluble polymers such as polyvinyl alcohol, polyacrylic acid copolymers, maleic acid copolymers, carboxymethyl cellulose, hydroxypropyl cellulose, hydroxypropylmethyl cellulose polyvinyl pyrrolidone, and gelatin; are also listed as preferable compounds. The preferable addition amount is 0.1 to 20 weight % based on silver aliphatic carboxylates.

Alcohols having not more than 10 carbon atoms, preferably a secondary alcohol or a tertiary alcohol, can reduce the viscosity by increasing the solubility of sodium aliphatic carboxylates at the precipitation process, which realizes a higher monodispersity and a smaller grain size due to enhanced stirring efficiency. Branched chain aliphatic carboxylic acids and aliphatic unsaturated carboxylic acids exhibit higher steric hindrance than silver straight chain aliphatic carboxylates which are the main component in crystalization of silver aliphatic carboxylates, so that large crystals cannot be formed due to large disorder of crystal lattice, which results in formation of smaller size grains.

As described above, the most different point in the constitution of conventional silver halide photographic materials silver salt photothermographic dry imaging materials compared to that of is that conventional silver halide photographic materials, in the former materials disregarding before or after the development, there are contained a large quantity of photosensitive silver halides, organic silver salts and reducing agents, which may become a cause of generating fog and print-out silver. Therefore, in silver salt photothermographic dry imaging materials, in order to maintain the storage stability not only before development but also after development, superior techniques of fog prevention and image stabilization is indispensable; and, heretofore, in addition to aromatic heterocyclic compounds which depress growth of fog nuclei and development, were used mercury compounds such as mercury acetate which function to diminish fog nuclei by oxidation, as an extremely effective storage stabilizer; however, application of the mercury compounds was problematic in respect to safety and environmental conservation.

Antifoggants and image stabilizers employed in the silver salt photothermographic dry imaging material of the invention will be explained below.

In the silver salt photothermographic dry imaging material of the invention, since reducing agents having a proton such as bisphenols and sulfonamide phenols are mainly employed as described later, compounds which can deactivate the reducing agents by generating an active species which can abstract a hydrogen from these compounds are preferably contained. Suitably, preferred compound is a colorless photo-oxidizing substance capable of generating free radicals as a reactive species at the exposure.

Therefore, any compounds having these functions can be used, and an organic free radical comprising plural atoms is preferred. Compounds of any structure can be used, provided that they have such a function and cause no specific harmful effects to silver salt photothermographic dry imaging materials.

Further, these compounds which generate a free radical preferably contains a carbocyclic or a heterocyclic aromatic group so that the generated free radicals have such stability as showing sufficient contact time to react with and deactivate reducing agents.

The representative compounds can include biimidazolyl compounds and iodonium compounds described below.

Biimidazolyl compounds include ones represented by the following formula (1).

Formula (1)

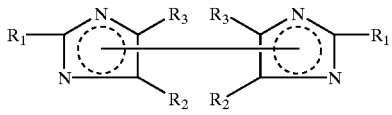

wherein, each of $R^1$, $R^2$ and $R^3$ (being identical to or different from each other) represents an alkyl group (for example, methyl, ethyl and hexyl), an alkenyl group (for example, vinyl and allyl), an alkoxy group (for example, methoxy, ethoxy and octyloxy), an aryl group (for example, phenyl, naphthyl and tolyl), a hydroxyl group, a halogen atom, an aryloxy group (for example, phenoxy), an alkylthio group (for example methylthio and butylthio), an arylthio group (for example, phenylthio), an acyl group (for example, acetyl, propionyl, butyryl and valeryl), a sulfonyl group (for example, methylsulfonyl and phenylsulfonyl), an acylamino group, a sulfonylamino group, an acyloxy group (for example, acetoxy and benzoxy), a carboxyl group, a cyano group, a sulfo group and an amino group. Among these, more preferable substituents are an aryl group, an alkenyl group and a cyano group.

The biimidazolyl compounds described above can be prepared according to manufacturing methods described in U.S. Pat. No. 3,734,733 and British Patent No. 1,271,177 and the similar methods thereof. Preferable specific examples are listed below.

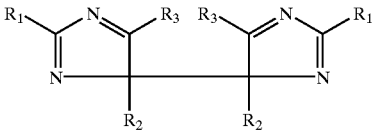

| | $R_1$ | $R_2$ | $R_3$ |
|---|---|---|---|
| BI-1 | H | CN | H |
| BI-2 | CN | H | CN |
| BI-3 | $CF_3$ | H | $CF_3$ |
| BI-4 | 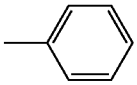 | 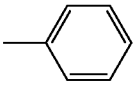 | 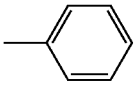 |

-continued
| | | | |
|---|---|---|---|
| BI-5 | 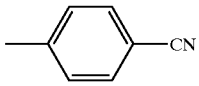 | 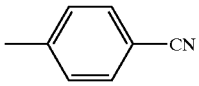 | 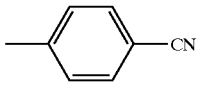 |
| BI-6 | 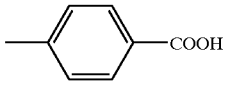 | 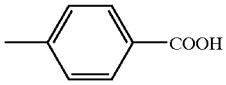 | 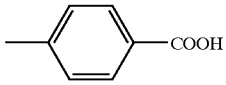 |
| BI-7 | H | —CH=CH$_2$ | H |
| BI-8 | 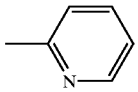 | 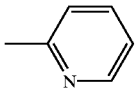 | 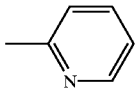 |
| B-9 | 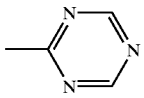 | 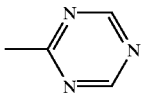 | 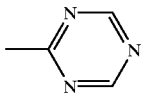 |
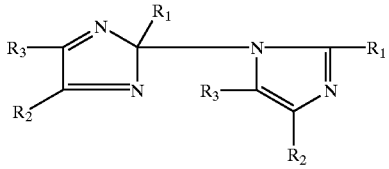
| | $R_1$ | $R_2$ | $R_3$ |
|---|---|---|---|
| BI-10 | H | 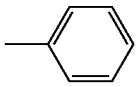 | 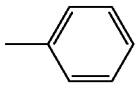 |
| BI-11 | CN | H | H |
| BI-12 | CN | 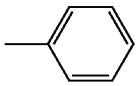 | 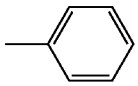 |
| BI-13 | H | 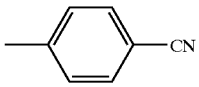 | 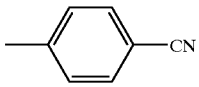 |
| BI-14 | H | $CF_3$ | H |
| BI-15 | H | 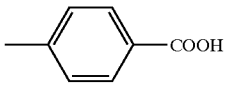 | 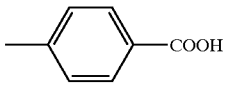 |
| BI-16 | H | 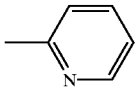 | 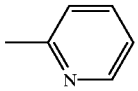 |

Further, similarly suitable compounds include iodonium compounds represented by the following formula (2).

Formula (2)

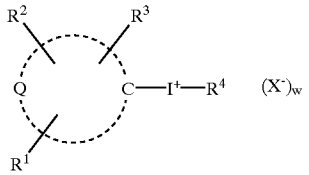

wherein, Q is an atom group necessary to complete a 5-, 6- or 7-membered cyclic ring, and the atom group is selected from a carbon atom, a nitrogen atom, an oxygen atom and a sulfur atom. Each of $R^1$, $R^2$ and $R^3$ (being identical to or different from each other) represents a hydrogen atom, an alkyl group (for example, methyl, ethyl and hexyl), an alkenyl group (for example, vinyl and allyl), an alkoxy group (for example, methoxy, ethoxy and octyloxy), an aryl group (for example, phenyl, naphthyl and tolyl), a hydroxyl group, a halogen atom, an aryloxy group (for example, phenoxy), an alkylthio group (for example, methylthio and butylthio), an arylthio group (for example, phenylthio), an acyl group (for example, acetyl, propionyl, butyryl and valeryl), a sulfonyl group (for example, methylsulfonyl and phenylsulfonyl), an acylamino group, a sulfonylamino group, an acyloxy group (for example, acetoxy and benzoxy), a carboxyl group, a cyano group, a sulfo group and an amino group. Among these, more preferable substituents are an aryl group, an alkenyl group and a cyano group.

$R^4$ represents a carboxylate group such as acetate, benzoate and trifluoroacetate, and $O^-$. W represents 0 or 1.

$X^-$ is an anionic counter ion, and suitable examples are $CH_3CO_2^-$, $CH_3SO_3^-$ and $PF_6^-$.

When $R^3$ is a sulfo group or a carboxyl group, W is 0 and $R^4$ is O−.

Moreover, any one of $R^1$, $R^2$ and $R^3$ may bond the other one to form a ring.

Among these, specifically preferable compounds are represented by the following formula (3).

Formula (3)

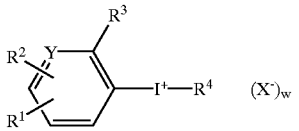

wherein, $R^1$, $R^2$, $R^3$, $R^4$ $X^-$ and W represents the same as defined in the formula (2) described above, and Y represents a carbon atom (—CH═; benzene ring) or a nitrogen atom (—N═; pyridine ring).

The iodonium compounds described above can be synthesized according to the preparation methods described in Org. Syn., 1961 and Fieser, "Advanced Organic Chemistry" (Reinhold, N.Y., 1961) and the similar methods.

The addition amount of the compounds represented by formula (1) and [2] described above is 0.001 to 0.1 mol/$m^2$, and preferably 0.005 to 0.05 mol/$m^2$. The compounds, in photosensitive materials of the invention, can be incorporated in any constitution layer, however, are preferably incorporated in the vicinity of reducing agents.

Further, as compounds which deactivate reducing agents so as to make the reducing agents unable to reduce silver aliphatic carboxylates to silver, preferable are those generating reactive species of non-halogen atoms, however compounds generating halogen atoms as labile species also can be employed when they are employed together with compounds generating non-halogen atoms as labile species. Many compounds capable of generating halogen atoms as labile species are commonly known, and the combination use exhibits superior effect.

The specific examples of the compounds generating labile halogen atoms include those represented by the following formula (4):

Formula (4)

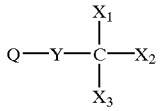

wherein Q represents an aryl group or a heterocyclic group. $X_1$, $X_2$ and $X_3$ represent a hydrogen atom, a halogen atom, an acyl group, an alkoxycarbonyl group, an aryloxycarbonyl group, a sulfonyl group or an aryl group, and at least one is a halogen atom. Y represents —C(═O)—, —SO— or —$SO_2$—.

Aryl groups represented by Q, which may form a monocyclic ring or a condensed ring, are preferably single- or double-ring aryl groups having 6 to 30 carbon atoms (for example, such as phenyl and naphthyl), more preferably a phenyl group and a naphthyl group, and furthermore preferably a phenyl group.

Heterocyclic groups represented by Q are 3 to 10 membered saturated or unsaturated heterocyclic groups containing at least one atom of N, O or S, and may be a single ring or further form a condensed ring with other rings.

Heterocyclic groups are preferably 5 to 6 membered unsaturated heterocyclic groups which may have condensed rings, and more preferably 5- to 6-membered aromatic heterocyclic groups which may have condensed rings. Furthermore preferably, they are 5- to 6-membered aromatic heterocyclic groups which may have condensed rings containing nitrogen atoms, and specifically preferably 5 to 6 membered aromatic heterocyclic groups which may have condensed rings containing 1 to 4 nitrogen atoms. Heterocyclic rings in these heterocyclic groups preferably include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene, more preferably imidazole, pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetrazaindene, furthermore preferably imidazole, pyridine, pyrimidine, pyrazine, pyridazine, triazole, triazine, thiadiazole, quinoline, phthaladine, naphthyridine, quinoxaline, quinazoline, cinnoline, tetrazole, thiazole, benzimidazole and benzthiazole, and specifically preferably pyridine, thiadiazole, quinoline and benzthiazole.

Aryl groups and heterocyclic groups represented by Q may contain substituents other than —Y—C ($X_1$) ($X_2$) ($X_3$), and the substituents preferably include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureide group, an amidophosphate group, a halogen atom, a cyano group, a sulfo group, a carboxyl group, a nitro group and a heterocyclic group, more preferably an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureide group, an amidophosphate group, a halogen atom, a cyano group, a nitro group and a heterocyclic group, futhermore preferably an alkyl group, an aryl group, an alkoxy group, an aryloxy group, an acyl group, an acylamino group, a sulfonylamino group, a sulfamoyl group, a carbamoyl group, a halogen atom, a cyano group, a nitro group and a heterocyclic group, and specifically preferably an alkyl group, an aryl group and a halogen atom.

$X_1$, $X_2$ and $X_3$ represent preferably a halogen atom, a haloalkyl group, an acyl group, an alkoxycarbonyl group, an aryloxycarbonyl group, a carbamoyl group, a sufamoyl group, sulfonyl group or a heterocyclic group, more preferably a halogen atom, a haloalkyl group, an acyl group, an alkoxycarbonyl group, an aryloxycarbonyl group, a carbamoyl group or a sufonyl group, furthermore preferably a halogen atom or a trihalomethyl group, and specifically preferably a halogen atom. Among halogen atoms, a chlorine atom, a bromine atom and an iodine atom are preferable, and furthermore preferable are a chlorine atom and a bromine atom, and specifically preferable is a bromine atom.

Y represents —C(=O)—, —SO— or —$SO_2$—, and preferably —$SO_2$—.

The addition amount of these compounds is preferably within the range causing no problem involved in increased print-out silver produced from silver halide: not more than 150%, based on the ratio against the aforementioned compounds not generating a labile halogen radical, and more preferably not more than 100%.

Further, other than the compounds described above, compounds well known as conventional antifoggants may be incorporated in the silver salt photothermographic dry imaging material of the invention, and they may be ones capable of generating a labile species similar to those of above-described compounds or ones having different antifogging mechanism. For example, they include the compounds described in U.S. Pat. Nos. 3,589,903, 4,546,075, 4,452,885, JP-A 59-57234, U.S. Pat. Nos. 3,874,946, 4,756,999, JP-A 9-288328 and 9-90550. Further, other antifoggants include compounds disclosed in U.S. Pat. No. 5,028,523, European Patent Nos. 600,587, 605,981 and 631,176.

The suitable examples of the reducing agents to be included in the silver salt photothermographic dry imaging material of the invention are described in U.S. Pat. Nos. 3,770,448, 3,773,512, 3,593,863, Research Disclosure (hereinafter, may also be abbreviated as RD) Nos. 17029 and 29963, and can be suitably selected from reducing agents well known in the art. In the invention are preferable polyphenols in which two or more phenol groups are bonded by an alkylene group or sulfur; particularly bisphenols in which two or more phenol groups, in which at least one position of adjacent to hydroxy substituted positions being substituted by an alkyl group (such as a methyl group, an ethyl group, a propyl group, a t-butyl group and an cyclohexyl group) or an acyl group (such as an acetyl group and a propionyl group), are bonded by an alkylene group or sulfur; and, for example, compounds represented by the following formula (A):

Formula (A)

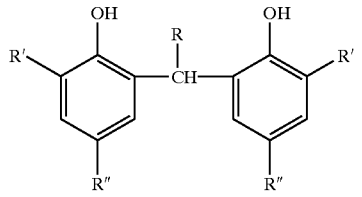

wherein R represents a hydrogen atom or an alkyl group having 1 to 10 carbon atoms (such as isopropyl, butyl, 2,4,4-trimethylpentyl), and R' and R" represent an alkyl group having 1 to 5 carbon atoms (such as methyl, ethyl and t-butyl).

Further, suitable examples also include polyphenol compounds described in U.S. Pat. Nos. 3,589,903 and 4,021,249, or in British Patent No. 1,486,148, JP-A 51-51933, 50-36110, 50-116023 and 52-84727, or in JP-B 51-35727 (JP-B refers to an examined Japanese Patent Publication); bisnaphtols such as 2,2'-dihydroxy-1,1'-binaphtyl and 6,6'-dibromo-2,2'-dihydroxy-1,1'-binaphtyl described in U.S. Pat. No. 3,672,904; and, further, sulfonamido phenols or sulfonamido naphthols, such as 4-benzenesulfonamido phenol, 2-benzenesulfonamido phenol, 2,6-dichloro-4-benzenesulfonamido phenol and 4-benzenesulfonamido naphthol described in U.S. Pat. No. 3,801,321.

The using amount of the reducing agent, for example, such a compound as represented by the formula (A) described above, is preferably $1\times10^{-2}$ to 10 mol, and furthermore preferably $1\times10^{-2}$ to 1.5 mol, based on 1 mol of silver.

The amount of reducing agents employed in the silver salt photothermographic dry imaging material of the invention varies depending on the kind of silver aliphatic carboxylates and reducing agents, and depending on other additives, however, is generaly 0.05 to 10 mol, and preferably 0.1 to 3 mol, based on 1 mol of silver aliphatic carboxylates. Two or more kinds of reducing agents described above may be employed in combination within the range of this amount. In the invention, it may be preferred that the reducing agents described above be added and mixed into the photosensitive emulsion solution, which is comprised of photosensitive silver halide, silver aliphatic carboxylates and solvents, just before coating and coated, so that the variation of photographic performances due to the standing time may become minimal.

The photosensitive silver halide grains according to the invention can be subjected to a chemical sensitization. Chemical sensitization centers (chemical sensitization nuclei) can be provided, utilizing compounds which release a calcogen ion such as sulfur, or noble metal compounds which release a gold ion, by the methods described, for example, in Japanese Patent Application Nos. 2000-057004 and 2000-061942. The chemical sensitization by use of the organic sensitizers including calcogen atoms, shown below, is preferred.

These organic sensitizing compounds including a calcogen atom are preferably provided with a group which can adsorb to silver halides and an unstable calcogen atom part.

As these organic sensitizers can be employed those having various structures disclosed in JP-A 60-150046, 4-109240 and 11-218874, and it is preferable to employ at least one kind of the compounds having a structure in which the calcogen atom is bonded to a carbon atom or a phosphor atom by a double bond.

The using amount of the calcogen compound as an organic sensitizer varies depending on the calcogen compound employed, the silver halide grains employed and the reaction environment to perform a chemical sensitization, however, is preferably $10^{-8}$ to $10^{-2}$ mol, and more preferably $10^{-7}$ to $10^{-3}$ mol, based on 1 mol of silver. The environment of the chemical sensitization according to the invention is not specifically limited, however, the calcogen sensitization is preferably applied in the presence of compounds which can diminish the silver calcogenide or the silver nuclei on the photosensitive silver halide grains or can reduce the size thereof, and specifically in the presence of oxidizer which can oxidize the silver nuclei, and as the conditions it is preferred a pAg of 6 to 11 and more preferred 7 to 10, a pH of 4 to 11 is preferred and more preferred 5 to 8, further, a sensitization temperature of not higher than 30° C. is preferred.

Accordingly, in the silver salt photothermographic dry imaging material of the invention, it is preferred to employ the photosensitive emulsion, in which the aforementioned photosensitive silver halide grains are subjected to a chemical sensitization at a temperature of not higher than 30° C., in the coexistence of an oxidizing agent capable of oxidizing the silver nuclei on the grains, dispersed as an mixture with the silver aliphatic carboxylates, dehydrated and dried.

The chemical sensitization using these organic sensitizers is preferably performed in the presence of spectral sensitizer or hetero-atom containing compounds having an adsorption power onto the silver halide grains. By performing the chemical sensitization in the presence of the compounds having an adsorption power onto the silver halide, the dispersion of the chemical sensitization center can be prevented to achieve a high sensitivity and low fog. Although the spectral sensitizer employed in the invention will be mentioned later, the hetero-atom containing compounds having an adsorption power onto the silver halide preferably include nitrogen containing heterocyclic compounds described in JP-A 3-24537 as preferable examples. In the nitrogen containing heterocyclic compounds employed in the invention, the heterocyclic ring can include such as a pyrazole ring, a pyrimidine ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, and a ring in which two or three of these rings are bonded, for example, such as a triazolotriazole ring, a diazaindene ring, a triazaindene ring and a pentaazaindene ring. The heterocyclic ring in which a single heterocyclic ring and an aromatic ring are condenced, for example, such as a phtharazine ring, a benzimidazole ring, an indazole ring and a benzthiazole ring are also applicable.

Among these is preferred an azaindene ring, and more preferred are azaindene compounds having a hydroxyl group as a substituent, for example, such as hydroxy triazaindene, tetrahydroxy azaindene and hydroxy pentaazaindene compounds.

The heterocyclic ring may contain a substituent other than a hydroxyl group. The substituents include, for example, such as an alkyl group, a substituted alkyl group, an alkylthio group, an amino group, a hydroxyamino group, an alkylamino group, a dialkylamino group, an arylamino group, a carboxyl group, an alkoxycarbonyl group, a halogen atom and a cyano group.

The addition amount of these heterocyclic compounds varies in a wide range depending on such as the size and the composition of the silver halide grains or other conditions, however, the approximate amount based on 1 mol of silver is in a range of $10^{-6}$ to 1 mol, and preferably in a range of $10^{-4}$ to $10^{-1}$.

The silver halide grains according to the invention can be subjected to a noble metal sensitization utilizing compounds which releases a noble metal ion such as an gold ion. For example, such as chloroaurates and organic gold compounds can be employed as gold sensitizers.

Further, other than the aforementioned sensitizing methods, reduction sensitization can also be employed, and as the specific compounds for a reduction sensitization, ascorbic acid, thiourea dioxide, stannous chloride, hydrazine derivatives, borane compounds, silane compounds, polyamine compounds, etc. can be used. Reduction sensitization also can be performed by ripening the emulsion while keeping the pH of the emulsion at not lower than 7 or the pAg at not higher than 8.3.

The silver halide to be subjected to a chemical sensitization according to the invention may be any of one formed in the presence of the organic silver salt or one formed in the absence of the organic silver salt, or the mixture thereof.

The photosensitive silver halide grains in the invention are preferably subjected to a spectral sensitization by adsorbing a spectral sensitizing dye onto the grains. The spectral sensitizing dyes such as cyanine dyes, merocyanine dyes, complex cyanine dyes, complex merocyanine dyes, holopolar cyanine dyes, styryl dyes, hemicyanine dyes, oxonol dyes and hemioxonol dyes can be employed. For example, the sensitizing dyes described in JP-A 63-159841, 60-140335, 63-231437, 63-259651, 63-304242, 63-15245, U.S. Pat. Nos. 4,639,414, 4,740,455, 4,741,996, 4,751,175 and 4,835,096 can be employed.

The useful spectral sensitizing dyes employed in the invention are described, for example, in item IV-A of RD No. 17643 (p.23, published in December 1978), item X of RD No. 18431 (p.437, published in August 1978) or the references therein. Specifically, sensitizing dyes having a spectral sensitivity suitable to the spectral characteristics of the light sources of various kinds of laser imagers and scanners are preferably employed. For example, the compounds described in JP-A 9-34078, 9-54409 and 9-80679 are preferably employed.

Useful cyanine dyes are ones which have a basic nucleus such as a thiazoline nucleus, an oxazoline nucleus, a pyrroline nucleus, a pyridine nucleus, an oxazole nucleus, a thiazole nucleus, a selenazole nucleus and an imidazole nucleus. Preferable ones of useful merocyanine dyes include, in addition to the basic nuclei above described, acidic nuclei such as a thiohydantoin nucleus, a rhodanine nucleus, a xazolidinedione nucleus, a thiazolinedione nucleus, a balbituric acid nucleus, a thiazolinone nucleus, a malonitrile nucleus and pyrazolone nucleus.

In the invention, spectral sensitizing dyes having spectral sensitivity particularly for infrared are also employed. Examples of infrared spectral sensitizing dyes employed preferably include ones disclosed in U.S. Pat. Nos. 4,536,473, 4,515,888 and 4,956,294.

As infrared spectral sensitizers, polymethine dyes characterized in that a sulfinyl group is substituted on a benzene ring of the benzazole ring are specifically preferable.

The infrared sensitizing dyes can be easily synthesized according to, for example, the method described in M. F. Harmer, "The Chemistry of Heterocyclic Compounds, volume 18" and "The Cyanine Dyes and Related Compounds" (A. Weissberger ed., Interscience Co., New York, 1964).

The addition timing of these infrared spectral sensitizing dyes may be at any stage after the preparation of silver halide, and can be added to the photosensitive emulsion which contains silver halide grains, or, silver halide grains and silver aliphatic carboxylate grains, for example, by means of adding into solvents or as so-called solid dispersion state in which dyes are dispersed as to form fine particles. Further, similar to the hetero-atom containing compounds capable of being adsorbed onto said silver halide grains, they can be adsorbed onto silver halide grains prior to the chemical sensitization, subsequently followed by chemical sensitization, so that chemical sensitization center nuclei are prevented from dispersing and high sensitivity and low fog can be achieved.

In the invention, aforementioned spectral sensitizing dyes may be employed alone or in combinations thereof, and the combination of sensitizing dyes often employed for the purpose of supersensitization.

In the photosensitive emulsion containing silver halide and silver aliphatic carboxylate, which is employed in the silver salt photohtermographic dry imaging material of the invention; a dye having no function of a spectral sensitization itself or a substance having no practical absorption within the visible region, which exhibit supersensitization, may be incorporated in the emulsion together with a sensitizing dye, and thereby the silver halide grains may be supersensitized.

Useful spectral sensitizing dyes, combinations of dyes exhibiting supersensitization and substances exhibiting supersensitization are described in item J of IV, p.23, RD 17643 (published in December 1978), or in JP-B 9-25500, 43-4933, JP-A 59-19032, 59-192242 and 5-341432, and preferable as supersensitizers are heterocyclic aromatic mercapto compounds represented below or mercapto derivative compounds:

Ar—SM wherein M is a hydrogen atom or an alkali metal atom, and Ar is an aromatic ring or a condensed aromatic ring containing one or more nitrogen, sulfur, oxygen, selenium or tellurium atoms. The heterocyclic aromatic ring is preferably benzimidazole, naphthimidazole, benzothiazole, naphthothiazole, benzoxazole, naphthoxazole, benzoselenazole, benzotellurazole, imidazole, oxazole, pyrazole, triazole, triazine, pyrimidine, pyridazine, pyrazine, pyridine, purine, quinoline or quinazolinone. However, other heterocyclic rings also may be listed.

Further, when the compound is incorporated in the dispersion of silver aliphatic carboxylate and/or a silver halide grain emulsion, the derivative compounds practically generating the mercapto compounds described above are also listed. Specifically the mercapto derivative compounds represented below are listed as preferable examples:

Ar—S—S—Ar wherein Ar represents the same as in the case of the mercapto compounds described above.

The heterocyclic aromatic ring above described may contain substituents selected from the group constituted of, for example, a halogen atom (for example, Cl, Br and I), a hydroxyl group, an amino group, a carboxyl group, an alkyl group (for example, one containing one or more carbon atoms, and preferably 1 to 4 carbon atoms) and an alkoxy group (for example, one containing one or more carbon atoms, and preferably 1 to 4 carbon atoms).

Other than supersensitizers described above, the compounds represented by the following formula (5) and macrocyclic compounds, which are disclosed in Japanese Patent Application 2000-070296, can be employed as supersensitizers:

Formula (5)

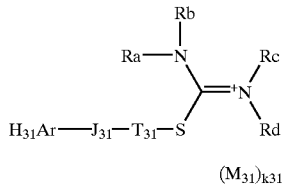

wherein $H_{31}Ar$ represents an aromatic hydrocarbon group or an aromatic heterocyclic group, $T_{31}$ represents a bivalent connecting group comprised of an aliphatic hydrocarbon group or a connecting group, and $J_{31}$ represents a bivalent connecting group containing one or more oxygen atoms, sulfur atoms or nitrogen atoms or a connecting group. Ra, Rb, Rc and Rd each represents a hydrogen atom, an acyl group, an aliphatic hydrocarbon group, an aryl group or a heterocyclic group, or a heterocyclic group containing nitrogen may be formed by making a bond between Ra and Rb, Rc and Rd, Ra and Rc, or, Rb and Rd. $M_{31}$ represents an ion required to cancel the electric charge in the molecule, and k31 is a number of ions required to cancel the electric charge in the molecule.

In the formula (5), the bivalent connecting group comprised of an aliphatic hydrocarbon group represented by $T_{31}$ is a straight chain, branched or cyclic alkylene group (having preferably 1 to 20 carbon atoms, more preferably of 1 to 16 carbon atoms, and furthermore preferably of 1 to 12 carbon atoms), alkenyl group (having preferably 2 to 20 carbon atoms, more preferably 2 to 16 carbon atoms, and furthermore preferably 2 to 12 carbon atoms), or alkynyl group (having preferably 2 to 20 carbon atoms, more preferably 2 to 16 carbon atoms, and furthermore preferably 2 to 12 carbon atoms) ; and they may contain substituents, for example, as aliphatic hydrocarbon group, a straight chain, branched or cyclic alkyl group (having preferably 1 to 20 carbon atoms, more preferably 1 to 16 carbon atoms, and furthermore preferably 1 to 12 carbon atoms), alkenyl group (having preferably 2 to 20 carbon atoms, more preferably 2 to 16 carbon atoms, and furthermore preferably 2 to 12 carbon atoms), alkynyl group (having preferably 2 to 20 carbon atoms, more preferably 2 to 16 carbon atoms, and furthermore preferably 2 to 12 carbon atoms), as aryl groups, an aryl group of a single-ring or a condensed-ring having 6 to 20 carbon atoms (for example, phenyl and naphthyl, and preferably phenyl), and as the heterocyclic groups, an unsaturated heterocyclic group of 3 to 10 membered (for example, 2-thiazolyl, 1-pyperazyl, 2-pyridyl, 3-pyridyl, 2-furyl, 2-thienyl, 2-benzimidazolyl, carbazolyl, etc.), whose heterocyclic ring may be a single ring or form a condensed ring with other rings. Each of these groups may have substituents at any position, and for example an alkyl group (including a cycloalkyl group and an alalkyl group; having preferably 1 to 20 carbon atoms, more preferably 1 to 12 carbon atoms and specifically preferably 1 to 8 carbon atoms; such as methyl, ethyl, n-propyl, iso-propyl, n-butyl, tert-butyl, n-heptyl, n-octyl, n-decyl, n-undecyl, n-hexadecyl, cycropropyl, cyclopentyl, cyclohexyl, benzyl and phenetyl), an alkenyl group (having preferably 2 to 20 carbon atoms, more preferably 2 to 12 carbon atoms and specifically preferably 2 to 8 carbon atoms; for example, such as vinyl, allyl, 2-butenyl and 3-pentenyl), an alkynyl group (having preferably 2 to 20 carbon atoms, more preferably 2 to 12 carbon atoms and specifically preferably 2 to 8 carbon atoms; for example, such as propargyl and 3-pentynyl), an aryl group (having preferably 6 to 30 carbon atoms, more preferably 6 to 20 carbon atoms and specifically preferably 6 to 12 carbon atoms; for eaxample, such as phenyl, p-tolyl, o-aminophenyl and naphthyl), an amino group (having preferably 0 to 20 carbon atoms, more preferably 0 to 10 carbon atoms and specifically preferably 0 to 6 carbon atoms; for example, such as amino, methylamino, ethylamino, dimethylamino, diethylamino, diphenylamino, and dibenzylamino), an imino group (having preferably 1 to 20 carbon atoms, more preferably 1 to 18 carbon atoms and specifically preferably 1 to 12 carbon atoms; for example, such as mehtylimino, ethylimino, propylimino and phenylimino), an alkoxy group (having preferably 1 to 20 carbon atoms, more preferably 1 to 12 carbon atoms and specifically preferably 1 to 8 carbon atoms; for example, such as methoxy, ethoxy and butoxy), an aryloxy group (having preferably 6 to 20 carbon atoms, more preferably 6 to 16 carbon atoms and specifically preferably 6 to 12 carbon atoms; for example, such as phenyloxy and 2-naphtyloxy), an acyl group (having preferably 1 to 20 carbon atoms, more preferably 1 to 16 carbon atoms and specifically preferably 1 to 12 carbon atoms; for example, such as acetyl, benzoyl, formyl and pivaloyl), an alkoxycarbonyl group (having preferably 2 to 20 carbon atoms, more preferably 2 to 16 carbon atoms and specifically preferably 2 to 12 carbon atoms; for example, such as methoxycarbonyl and ethoxycarbonyl), an aryloxycarbonyl group (having preferably 7 to 20 carbon atoms, more preferably 7 to 16 carbon atoms and specifically preferably 7 to 10 carbon atoms; for example, such as phenyloxycarbonyl), an acyloxy group (having preferably 1 to 20 carbon atoms, more preferably 1 to 16 carbon atoms and specifically preferably 1 to 10 carbon atoms; for example, such as acetoxy and benzoyloxy), an acylamino group (having preferably 1 to 20 carbon atoms, more preferably 1 to 16 carbon atoms and specifically preferably 1 to 10 carbon atoms; for example, such as acetylamino and benzoylamino), an alkoxycarbonylamino group (having preferably 2 to 20 carbon atoms, more preferably 2 to 16 carbon atoms and specifically preferably 2 to 12 carbon atoms; for example, such as methoxycarbonylamino), an aryloxycarbonylamino group (having preferably 7 to 20 carbon atoms, more preferably 7 to 16 carbon atoms and specifically preferably 7 to 12 carbon atoms; for eaxample, such as phenyloxycarbonylamino), a sulfonylamino group (having preferably 1 to 20 carbon atoms, more preferably 1 to 16 carbon atoms and specifically preferably 1 to 12 carbon atoms; for example, such as methanesulfonylamino and benzenesulfonylamino), a sulfamoyl group (having preferably 0 to 20 carbon atoms, more preferably 0 to 16 carbon atoms and specifically preferably 0 to 12 carbon atoms; for example, such as sulfamoyl, methylsulfamoyl, dimethylsulfamoyl and phenylsulfamoyl), a carbamoyl group (having preferably 1 to 20 carbon atoms, more preferably 1 to 16 carbon atoms and specifically preferably 1 to 12 carbon atoms; for example, such as carbamoyl, methylcarbamoyl, diethylcarbamoyl and phenylcarbamoyl), an alkylthio group (having preferably 1 to 20 carbon atoms, more preferably 1 to 16 carbon atoms and specifically preferably 1 to 12 carbon atoms; for example, such as methylthio and ethylthio), an arylthio group (having preferably 6 to 20 carbon atoms, more preferably 6 to 16 carbon atoms and specifically preferably 6 to 12 carbon atoms; for example, such as phenylthio), a sulfonyl group (having preferably 1 to 20 carbon atoms, more preferably 1 to 16 carbon atoms and specifically preferably 1 to 12 carbon atoms; for example, such as methanesulfonyl and tosyl), a sulfinyl group (having preferably 1 to 20 carbon atoms, more preferably 1 to 16 carbon atoms and specifically preferably 1 to 12 carbon atoms; for example, such as methanesulfinyl and benzenesulfinyl), an ureido group (having preferably 1 to 20 carbon atoms, more preferably 1 to 16 carbon atoms and specifically preferably 1 to 12 carbon atoms; for example such as ureido, methylureido and phenylureido), an amidophosphate group (having preferably 1 to 20 carbon atoms, more preferably 1 to 16 carbon atoms and specifically preferably 1 to 12 carbon atoms; for example, such as diethyl amidophosphate and phenyl amidophosphate), a hydroxy group, a mercapto group, a halogen atom (for example, such as a fluorine atom, a chlorine atom, a bromine atom and an iodine atom), a cyano group, a sulfo group, a sulfino group, a carboxyl group, a phosphno group, a phosphino group, a nitro group, a hydroxamic acid group, a hydrazino group, a hetrocyclic group (for example, such as imidazolyl, benzimidazolyl, thiazolyl, benzothiazolyl, carbazolyl, pyridyl, furyl, piperidyl and morpholino) are listed.

Among the groups described above, the groups capable of forming a salt, such as a hydroxyl group, a mercapto group, a sulfo group, sulfino group, a carboxyl group, a phosphono group and phosphino group, may be salts. These substituents may be further substituted. When two or more substituents are present, they may be either the same or different. The substituents are preferably an alkyl group, an alalkyl group, an alkoxy group, an aryl group, an alkylthio group, an acyl group, an acylamino group, an aryloxycarbonyl group, an acyloxy group, an acylamino group, an imino group, a sulfamoyl group, a sulfonyl group, a sulfonylamino group, a ureido group, an amino group, a halogen atom, a nitro group, a heterocyclic group, an alkoxycarbonyl group, a hydroxyl group, a sulfo group, a carbamoyl group and a carboxyl group, more preferably an alkyl group, an alkoxy group, an aryl group, an alkylthio group, an acyl group, an acylamino group, an imino group, a sulfonylamino group, an ureido group, an amino group, a halogen atom, a nitro group, a heterocyclic group, an alkoxycarbonyl group, a hydroxyl group, a sulfo group, a carbamoyl group and a carboxyl group, and futhermore preferably an alkyl group, an alkoxy group, an aryl group, an alkylthio group, an acylamino group, an imino group, an ureido group, an amino group, a heterocyclic group, an alkoxycarbonyl group, a hydroxyl group, a sulfo group, a carbamoyl group and a carboxyl group. The amino groups include those containing substituents, and substituents include, for example, such as an alkyl groups (such groups as methyl, ethyl, pyridylmethyl, benzyl, phenethyl, carboxybenzyl and aminophenylmethyl), an aryl group (such groups as phenyl, p-tolyl, naphthyl, o-aminophenyl and o-methoxyphenyl), a heterocyclic group (such groups as 2-thiazolyl, 2-pyridyl, 3-pyridyl, 2-furyl, 3-furyl, 2-thieno, 2-imidazolyl, benzothiazolyl and carbazolyl).

As the bivalent connecting group containing one or more oxygen atoms, sulfur atoms or nitrogen atoms represented by $J_{31}$ includes the following, and further the combinations thereof.

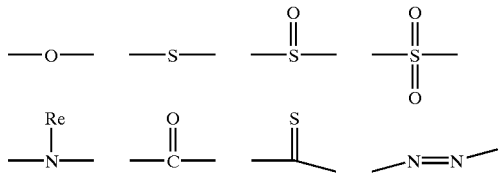

-continued

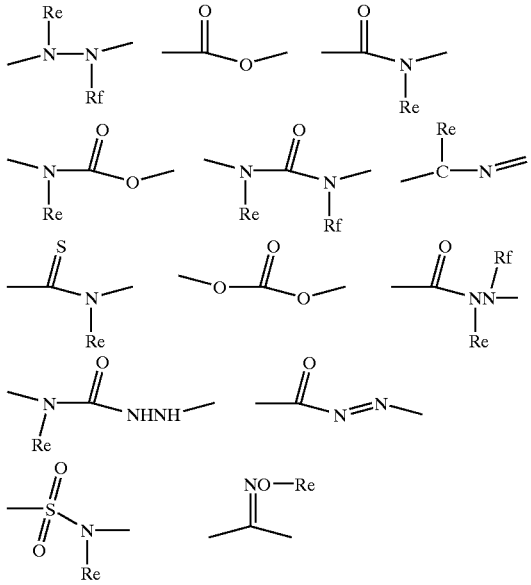

where, each of Re and Rf represents the same as defined in Ra to Rd described above.

The aromatic hydrocarbon group represented by $H_{31}Ar$ includes preferably ones having 6 to 30 carbon atoms, more preferably a single ring or condensed ring aryl group having 6 to 20 carbon atoms such as phenyl and naphthyl, and specifically preferably phenyl. The aromatic heterocyclic group represented by $H_{31}Ar$ is 5 to 10 membered heterocyclic ring groups containing at least one atom of N, O and S, and the heterocyclic ring may be a single ring or furher form a condensed ring with other rings. The heterocyclic rings in these heterocyclic groups are preferably 5 to 6 membered aromatic heterocyclic rings and benzo-condensed rings thereof, more preferably 5 to 6 membered aromatic heterocyclic rings containing nitrogen atoms and benzo-condensed rings thereof, and furthermore preferably 5 to 6 membered aromatic heterocyclic rings containing 1 or 2 nitrogen atoms and benzo-condensed rings thereof.

Specific examples of the heterocyclic group include, groups being derived from thiophene, furan, pyrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, benzothiazoline, benzotriazole, tetrazaindene and carbazole, preferably groups being derived from imidazole, pyrazole, pyridine, pyrazine, indole, indazole, thiadiazole, oxadiazole, quinoline, phenadine, tetrazole, thiazole, oxazole, benzimidazole, benzoxazole, benzothiazole, benzothiazoline, benzotriazole, tetrazaindene and carbazole, and furthermore preferably groups being derived from imidazole, pyridine, pyrazine, quinoline, phenadine, tetrazole, thiazole, benzoxazole, benzimidazole, benzothiazole, benzothiazoline, benzotriazole, and carbazole.

The aromatic hydrocarbon groups and the aromatic heterocyclic groups represented by $H_{31}Ar$ may be provided with substituents, which include, for example, groups similar to those substituents of $T_{31}$, and the preferable range is also similar. These substituents may be further substituted, and when there are two or more substituents, they may be either the same or different. The group represented by $H_{31}Ar$ is preferably an aromatic heterocyclic group.

The aliphatic hydrocarbon groups, the aryl groups and the heterocyclic groups represented by Ra, Rb, Rc and Rd can include groups similar to those listed as examples of aliphatic hydrocarbon groups, aryl groups and heterocyclic groups in case of $T_{31}$ described above, and the preferred range is also similar. The acyl groups represented by Ra, Rb, Rc and Rd are aliphatic or aromatic groups having 1 to 12 carbon atoms, and include, as concrete examples, groups such as acetyl, benzoyl, formyl and pivaloyl. The heterocyclic group containing nitrogen, which is formed by making a bond between Ra and Rb, Rc and Rd, Ra and Rc, or, Rb and Rd, includes 3 to 10 membered saturated and unsaturated heterocyclic ring groups (such as cyclic groups of a piperidine ring, a piperadine ring, an acridine ring, a pyrrolidine ring, a pyrrol ring and a morpholine ring).

The ions, which are required for compensating electric charge in the molecule, represented by $M_{31}$ include, as specific examples of an acid anion, a halogen ion (such as a chloride ion, a bromide ion and an iodide ion), a p-toluenesulfonate ion, a perchlorate ion, a tetrafluoroborate ion, a sulfate ion, a methylsulfate ion, a ethylsulfate ion, a methanesulfate ion and a trifluoromethanesulfate ion.

The supersensitizer according to the invention is preferably employed in the photosensitive layer containing organic silver salts and silver halide grains at an amount of 0.001 to 1.0 mol based on 1 mol of silver. Specifically preferable is an amount of 0.01 to 0.5 mol based on 1 mol of silver.

The silver saving agent employed in the invention refers to a compound capable of reducing the silver amount required to obtain an intended silver image density. Various working mechanisms of the reducing function can be considered, and compounds provided with a function of increasing the covering power of developed silver are preferred. Herein, the covering power of developed silver refers to optical density based on a unit amount of silver. The silver saving agent can be present in photosensitive layers or in photo-insensitive layers, or further in both thereof.

The silver saving agents include, as preferable examples, hydrazine derivatives represented by the following formula (H), vinyl compounds represented by the following formula (G), and quarternary onium compounds represented by the following formula (P).

Formula (G)

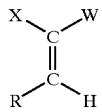

Formula (P)

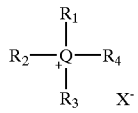

Formula (H)

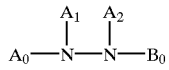

In the formula (H), $A_0$ represents an aliphatic group, an aromatic group, a heterocyclic group or —$G_0$—$D_0$ group, which may be provided with substituents, respectively; $B_0$ represents a blocking group; and, as for $A_1$ and $A_2$, both are hydrogen atoms or one is a hydrogen atom and the other is a acyl group, a sulfonyl group or an oxalyl group. Herein, $G_0$ represents —CO— group, —COCO— group, —CS— group, —C(=$NG_1D_1$)— group, —SO— group, —$SO_2$— group or —P(O)($G_1D_1$)— group; $G_1$ represents, simply a connecting hand, —O— group, —S— group or —N($D_1$)— group; and $D_1$ represents an aliphatic group, an aromatic group, a heterocyclic group or a hydrogen atom, when plural $D_1$'s present in the molecule they may be either the same or different. $D_0$ represents a hydrogen atom, an aliphatic group, an aromatic group, a heterocyclic group, an amino group, an alkoxy group, an aryloxy group, an alkylthio group and an arylthio group. Preferable $D_0$ includes a hydrogen atom, an alkyl group, an alkoxy group and an amino group.

In the formula (H), aliphatic groups represented by $A_0$ are preferably ones having 1 to 30 carbon atoms, specifically preferably straight chain, branched chain or cyclic alkyl groups having 1 to 20 carbon atoms, and include, for example, methyl, ethyl, t-butyl, octyl, cyclohexyl and benzyl, which may be further substituted by suitable substituents (such as, an aryl group, an alkoxy group, an aryloxy group, an alkylthio group, an arylthio group, a sulfoxy group, a sulfonamide group, a sulfamoyl group, an acylamino group, an ureide group, etc.).

In the formula (H), aromatic groups represented by $A_0$ are preferably single ring or condensed ring aryl groups, and include, for example, a benzene ring and a naphthalene ring; and heterocyclic groups represented by $A_0$ are preferably single rings or condensed rings containing at least one hetero atom selected from a nitrogen atom, a sulfur atom and an oxygen atom, and include, for example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring. Aromatic groups, heterocyclic groups and —$G_0$—$D_0$ group represented by $A_0$ may be provided with substituents. Specifically preferable as $A_0$ are an aryl group and —$G_0$—$D_0$ group.

Further, in the formula (H), $A_0$ preferably contains at least one anti-diffusion group or silver halide adsorbing group. As an anti-diffusion group, are preferable ballast groups commonly employed in immobile photographic additives such as couplers, and the ballast groups include an alkyl group, an alkenyl group, an alkynyl group, an alkoxy group, a phenyl group, a phenoxy group, an alkylphenoxy group, etc. which are photographically inactive, wherein the total number of carbon atoms at the substituent portions is preferably not less than 8.

In the formula (H), silver halide adsorption accelerating groups include thiourea, a thiourethane group, a mercapto group, a thioether group, a thione group, a heterocyclic group, a thioamide heterocycric group, a mercapto heterocyclic group, and adsorbing groups described in JP-A 64-90439.

In the formula (H), $B_0$ represents a blocking group, and is preferably $G_0D_0$ group, wherein $G_0$ represents —CO— group, —COCO— group, —CS— group, —C(=N$G_1D_1$)— group, —SO— group, —$SO_2$— group or —P(O)($G_1D_1$)— group. Preferable $G_0$ includes —CO— group and —COCO— group, $G_1$ represents a simple connecting hand, —O— group, —S— group or —N($D_1$)— group, $D_1$ represents an aliphatic group, an aromatic group, a heterocyclic group or a hydrogen atom, and, when plural $D_1$'s are present in the molecule, they may be either the same or different. $D_0$ represents a hydrogen atom, an aliphatic group, an aromatic group, a heterocyclic group, an amino group, an alkoxy group, an aryloxy group, an alkylthio group or an arylthio group, and preferable $D_0$ includes a hydrogen atom, an alkyl group, an alkoxy group and an amino group. As $A_1$ and $A_2$, both represents a hydrogen atom or one is a hydrogen atom and the other is an acyl group (such as an acetyl group, a trifluoroacetyl group or a benzoyl group), a sulfonyl group (such as a methanesulfonyl group or a toluenesulfonyl group) and an oxazalyl (such as ethoxazalyl).

The compounds represented by the formula (H) of the invention can be easily synthesized by methods well known in the art. For example, they can be synthesized in reference to U.S. Pat. Nos. 5,464,738 and 5,496,695.

The hydrazine derivatives preferably employed other than these are compounds H-1 to H-29 described in columns 11 to 20 of U.S. Pat. No. 5,545,505 and compounds 1 to 12 described in columns 9 to 11 of U.S. Pat. No. 5,464,738. These hydrazine derivatives can be synthesized by methods well known in the art.

In formula (G), although X and R are expressed in cis forms, trans forms are also included in formula (G). This is the same in the structural expression of specific compounds.

In formula (G), X represents an electron attracting group, and W represents a hydrogen group, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, a oxysulfinyl, a sulfinamoyl group, a phosphoryl group, a nitro group, an imino group, an N-carbonylimino group, an N-sulfinylimino group, a dicyanoethylene group, an ammonium group, a sulfonium group, a phosphonium group, a pyrylium group or an immonium group.

R represents a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt (for example, a sodium salt, a potassium salt or a silver salt) of a hydroxyl group or a mercapto group, an amino group, an alkylamino group, a cyclic amino group (for example, a pyrrolidino groupe), an acylamino group, an oxycarbonylamino group, a heterocyclic group (a 5 to 6 membered heterocyclic ring such as a benztriazole group, an imidazolyl group, a triazolyl group or tetrazolyl group), an ureido group or a sulfonamide group. X and W, and, X and R, may form a cyclic structure by bonding each other, respectively. The rings formed by X and W include, for example, pyrazolone, pyrazolidinone, cyclopentadione, β-ketolactone and β-ketolactam.

To further explain about the formula (G), the electron attracting group represented by X means a group whose substituent constant σp can be a positive value. Concretely, substituted alkyl groups (such as halogen substituted alkyl), substituted alkenyl groups (such as cyanovinyl), substituted and unsubstituted alkynyl groups (such as trifluoromethylacetylen and cyanoacetylenyl), substituted aryl groups (such as cyanophenyl), substituted and unsubstituted heterocyclic groups (such as pyridyl, triazinyl and benzoxazolyl), halogen atoms, cyano groups, acyl groups (such as acetyl, trifluoroacetlen and formyl), thioacetyl groups (such as thioacetyl and thioformyl), oxalyl groups (such as ethylthiooxalyl), oxyoxalyl groups (such as ethoxalyl), thiooxalyl groups (such as ethylthiooxalyl), oxamoyl groups (such as methyloxamoyl), oxycarbonyl groups (such as ethoxycarbonyl), carboxyl groups, thiocarbonyl groups (such as ethylthiocarbonyl), carbamoyl groups, thiocarbamoyl groups, sulfonyl groups, sulfinyl groups, oxysulfonyl groups (such as ethoxysulfonyl), thiosulfonyl groups (such as ethylthiosulfonyl), sulfamoyl groups, oxysulfinyl groups (such as methoxysulfinyl), thiosulfinyl groups (such as methylthiosulfinyl), sulfinamoyl groups, phophoryl groups, nitro groups, imino groups, N-carbonylimino groups (such as N-acetylimino), N-sulfonylimino groups (such as N-methanesulfonylimino), dicyanoethylene groups, ammonium groups, sulfonium groups, phosphonium groups, pyrylium groups and immonium groups are listed, and the heterocyclic members whose rings are formed by an ammonium group, an sulfonium group, a phosphonium group, an immonium group are also listed. Substituents having a Hammett σp value of not less than 0.30 is specifically preferred.

Alkyl groups represented by W include methyl, ethyl, trifluoromethyl, etc.; alkenyl groups include vinyl, halogen substituted vinyl, cyanovinyl, etc.; aryl groups include nitrophenyl, cyanophenyl, pentafluorophenyl, etc.; and, heterocyclic groups include pyridyl, pyrimidyl, triazinyl, succsineimido, tetrazolyl, triazolyl, imidazolyl and benzoxazolyl. W is preferably an electron attracting group having a positive σp value, and further the value is preferably not less than 0.30.

Among aforementioned substituents of R, preferably included are a hydroxyl group, a mercapto group, an alkoxy group, an alkylthio group, a halogen atom, an organic or inorganic salt of a hydroxyl group or a mercapto group, and a heterocyclic group; more preferably are a hydroxyl group, an alkoxy group, an organic or inorganic salt of a hydroxyl group or a mercapto group, and a heterocyclic group; and specifically preferably a hydroxyl group, an organic or inorganic salt of a hydroxyl group or a mercapto group.

Further, among the aforementioned substituents of X and W, those having a thioether bond in the molecule are preferred.

In the formula (P), Q represents a nitrogen atom or a phosphor atom, each of $R_1$, $R_2$, $R_3$ and $R_4$ represents a hydrogen atom or a substituent, and $X^-$ represents an anion. Wherein, $R_1$ to $R_4$ may form a ring by bonding each other.

Substituents represented by $R_1$ to $R_4$ include an alkyl group (such as a methyl group, an ethyl group, a propyl group, a butyl group, a hexyl group or a cyclohexyl group), an alkenyl group (such as an allyl group or a butenyl group), an alkynyl group (such as a propargyl group or a butynyl group), an aryl groups (such as a phenyl group or a naphthyl group), a heterocyclic groups (such as a piperidinyl group, a piperadinyl group, a morpholinyl group, a pyridyl group, a furyl group, a thienyl group, a tetrahydrofuryl group, a tetrahydrothienyl group or a sulfolanyl group) and an amino group.

The rings formed by bonding of $R_1$ to $R_4$ each other include a piperidine ring, a morpholine ring, a piperadine ring, a quinuclidine ring, a pyridine ring, a pyrole ring, an imidazole ring, a triazole ring and a tetrazole ring.

The groups represented by $R_1$ to $R_4$ may be provided with substituents such as a hydroxyl group, an alkoxy group, an aryloxy group, a carboxyl group, a sulfo group, an alkyl group and an aryl group. As $R_1$, $R_2$, $R_3$ and $R_4$ are preferable a hydrogen atom and an alkyl group.

Anions represented by $X^-$ include inorganic and organic anions such as a halogen ion, a sulfate ion, a nitrate ion, an acetate ion a p-toluenesulfonate ion.

Quaternary onium compounds described above can be easily synthesized according to methods well known in the art, and, for example, tetrazolium compounds described above can be synthesized in reference to the method described in Chemical Reviews, vol. 55, pp. 335 to 483. The addition amount of silver saving agents described above is in the range of $10^{-5}$ to 1 mol, and preferably $10^{-4}$ to $5\times10^{-1}$ mol, based on 1 mol of silver aliphatic carboxylates.

Binders suitable for the silver salt photothermographic dry imaging material of the present invention are transparent or translucent, and generally colorless. The binders include natural polymers, synthetic resins, and polymers and copolymers, as well as other film forming media; for example, gelatin, gum arabic, poly(vinyl alcohol), hydroxyethyl cellulose, cellulose acetate, cellulose acetate butyrate, poly(vinylpyrrolidone), casein, starch, poly(acrylic acid), poly(methylmethacrylic acid), poly(vinyl chloride), poly (methacrylic acid), copoly(styrene-maleic anhydride), copoly(styrene-acrylonitrile), copoly(styrene-butadiene), poly(vinyl acetal) series (for example, poly(vinyl forrnal) and poly(vinyl butyral)), poly(ester) series, poly(urethane series, phenoxy resins, poly(vinylidene chloride), poly (epoxide) series, poly(carbonate) series, poly(vinyl acetate) series, cellulose esters, and poly(amide) series. These may be hydrophilic or hydrophobic.

Preferable binders for the photosensitive layer of the silver salt phtothermographic dry imaging material according to the invention are polyvinyl acetal series, and a specifically preferable binder is polyvinyl butyral. This will be detailed later. Further for over coat layers and under coat layers, particularly for photo-insensitive layers such as protective layers and back coat layers, are preferable polymers having a higher softening temperature such as cellulose ester series, specifically triacetyl cellulose and cellulose acetate butyrate. Herein, optionally, the combinations of two or more kinds of binders described above may be employed.

These binders are employed in the range of being effective for them to function as a binder. The effective range is easily determined by manufacturers in the art. For example, as an indication when they hold at least silver aliphatic carboxylates in a photosensitive layer, the ratio of the binder to silve aliphatic carboxylates is preferably in the range of 15:1 to 1:2, and specifically preferably in the range of 8:1 to 1:1. That means, the amount of binders in a photosensitive layer is preferably 1.5 to 6 g/m$^2$, and furthermore preferably 1.7 to 5 g/m$^2$. When it is less than 1.5 g/m$^2$, densities in the unexposed area largely increased and the material may become unusable.

The invention is characterized in that the thermal transition temperature, after photothermobraphic processing at not lower than 100° C., is not lower than 46° C. and not higher than 200° C. The thermal transition temperature in the invention is the value obtained in a VICAT softening point or a ring and ball test, and indicates the thermal absorption peak of the photothermographically processed photosensitive layer isolated, measured by the use of a differential scanning calorimeter (DSC): for example, EXSTAR 6000 (manufactuered by Seiko Denshi Co.), DSC 220C (manufactured by Seiko Denshi Kogyo Co.) and DSC-7 (manufactured by Perkin-Elmer Co.). Generally, a polymeric compound possesses a glass transition temperature Tg, however, in the silver salt photothermographic dry imaging materials a large absorption peak appears in the region lower than the Tg value of a binder resin employed in the photosensitive layer. As a result of intensive studies with paying attention to this thermal transition temperature, it has been newly found that by making the thermal transition temperature not lower than 46° C. and not higher than 200° C., the fastness of the coated film is increased as well as photograhic performances such as sensitivity, maximum density and image retention quality are greatly enhanced, to achieve the present invention.

The glass transition temperature (Tg) is obtained according to the method described in Brandrup et al, "Polymer Handbook" III, pp.139 to 179 (published by Wiley & Sons Co.,1966), and when the binder is a copolymer resin, the Tg can be obtained by the following equation.

$$Tg\ (\text{copolymer})\ (^\circ\ \text{C.})=v_1Tg_1+v_2Tg_2+\ldots+v_nTg_n$$

wherein, $v_1$, $v_2$, . . . $v_n$ represent weight ratio of monomers in the copolymer, and $Tg_1$, $Tg_2$ . . . $Tg_n$ represent Tg (° C.) of homopolymers obtained from each monomer in the copolymer. The accuracy of Tg calculated according to the above equation is ±5° C.

In the silver salt photothermographic dry imaging material of the invention, as binders incorporated in the photosensitive layer, which includes such as silver aliphatic carboxylates, photosensitive silver halide grains and reducing agents on a support, can be employed high polymers well known in the art. The high polymers have a Tg of 70 to 105° C., a number average molecular weight of 1,000 to 1,000,000, preferably of 10,000 to 500,000, and a degree of polymerization of approximately 50 to 1,000. The examples include; compounds comprised of polymers or copolymers containing ethylenic unsaturated monomers as a constitutive unite such as vinyl chloride, vinyl acetate, vinyl alcohol, maleic acid, acrylic acid, acrylate ester, vinilidene chloride, acrylonitrile, methacrylic acid, methacrylate ester, styrene, butadiene, ethylene, vinyl butyral, vinyl acetal and vinyl ether; polyurethane resins and various kinds of rubber resins.

Further, phenol resins, epoxy resins, polyurethane curable resins, urea resins, melamine resins, alkyd resins, formaldehyde resins, silicone resins, epoxy-polyamide resins and polyester resins are listed. These resins are detailed in "Plastics Handbook" published by Asakura Shoten. These high polymers are not particularly limited, and may be homopolymers or copolymers provided that the glass transition temperatures of the porymers derived are in a range of 70 to 105° C.

The polymers or copolymers containing ethylenic unsaturated monomers as a constitutive unite include alkylacrylate ester series, arylaclylate ester series, alkylmehtacrylate ester series, arylmethacrylate ester series, alkylcyanoacrylate ester series, arylcyanoacrylate ester series, etc., wherein alkyl groups and aryl groups therof may be substituted, and concletely methyl, ethyl, n-propyl, isopropyl, n-butyl, isobutyl, sec-butyl, tert-butyl, amyl, hexyl, cyclohexyl, benzyl, chlorobenzyl, octyl, stearyl, sulfopropyl, N-ethylphenylaminoethyl, 2-(3-phenylpropyloxy)ethyl, dimethylaminophenoxyethyl, furufryl, tetrahydrofurufryl, phenyl, crezyl, naphthyl, 2-hydroxyethyl, 4-hydroxybutyl, triethylene glycol, dipropylene glycol, 2-methoxyethyl, 3-methoxybutyl, 2-acetoxyethyl, 2-acetoacetoxyehtyl, 2-ethoxethyl, 2-iso-propoxyethyl, 2-butoxyethyl, 2-(2-methoxyethoxy)ethyl, 2-(2-ethoxyethoxy)ethyl, 2-(2-butoxyethoxy)ethyl, 2-diphenylphosphorylethyl, ω-methoxypolyethylene glycol (an addition mole number: n=6), allyl and dimethylaminoethylmethylchloride salt are listed.

Further, the following monomers can be employed: vinyl ester series such as vinyl acetate, vinyl propionate, vinyl butylate, vinyl isobutylate, vinyl caproate, vinyl chloroacetate, vinyl methoxyacetate, vinyl phenylacetate, vinyl benzoate and vinyl salicylate; N-substituted acrylamide series, N-substituted methacrylamide series, acrylamide and methacrylamide, wherin N-substituents include methyl, ethyl, propyl, butyl, tert-butyl, cyclohexyl, benzyl, hydroxymethyl, methoxyethyl, dimethylaminoethyl, phenyl, dimethyl, diethyl, β-cyanoethyl, N-(2-acetoacetoxyethyl), diacetone, etc.; olefine series such as dicyclopentadiene, etylene, propyrene, 1-butene, 1-pentene, vinyl chloride, vinylidene chloride, isoprene, chloroprene, butadiene and 2,3-dimethylbutadiene; styrene series such as methylstyrene, dimethylstyrene, trimethylstyrene, ethylstyrene, isopropylstyrene, tert-butylstyrene, chloromethylstyrene, methoxystyrene, acotoxystyrene, chlorostyrene, dichlorostyrene, bromostyrene and methyl vinylbenzoate ester; vinyl ether series such as methyl vinyl ether, butyl vinyl ether, hexyl vinyl ether, methoxyethyl vinyl ether and dimethylaminoethyl vinyl ether; N-substituted maleimide series, whrein, N-substituents are methyl ethyl, propyl, butyl, tert-butyl, cyclohexyl, benzyl, n-dodecyl, phenyl, 2-methylphenyl, 2,6-diethylphenyl, 2-chlorophenyl, etc.; others include butylcrotonate, hexyl crotonate, dimethyl itaconate, dibutyl itaconate, diethyl maleate, dimetyl maleate, dibutyl maleate, diethyl fumarate, dimethyl fumarate, methyl vinyl ketone, pheny vinyl ketone, methoxyethyl vinyl ketone, grycidyl acrylate, grycidyl methacrylate, N-vinyl oxazoline, N-vinyl pyrrolidone, acrylonitrile, methacryronitrile, methylene malononitrile and vinylidene chloride.

Among these, specifically preferable examples include alkyl methacrylate ester series, arylmethacrylate ester series and styrene series. Among these high polymers, compounds having an acetal group are preferably employed. Since high polymers having an acetal group are superior in compatibility with aliphatic carboxylic acids formed, it is preferred that the effect to prevent softening of the film is remarkable.

Specifically preferable as high polymers having an acetal group are the compounds represented by the following formula (V).

Formula (V)

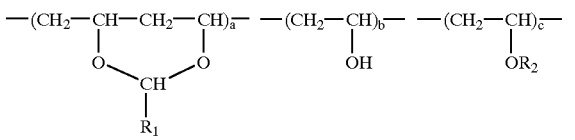

wherein, $R_1$ represents an alkyl group, a substituted alkyl group, an aryl group or a substituted aryl group, and preferably groups other than an aryl group. $R_2$ represents an unsubstituted alkyl group, a substituted alkyl group, an unsubstituted aryl group, a substituted aryl group, —$COR_3$ or —$CONHR_3$. $R_3$ represents the same as $R_1$.

Unsubstituted alkyl groups represented by $R_1$, $R_2$ and $R_3$ are preferably ones having 1 to 20 carbon atoms, and specifically preferably 1 to 6 carbon atoms. These may be of straight chain or branched, and specifically preferable is a straight chain alkyl group. These unsubstituted alkyl groups include, for example, a methyl group, an ethyl group, an n-propyl group, an isopropyl group, a n-butyl group, an isobutyl group, a t-butyl group, a n-amyl group, a t-amyl group, an n-hexyl group, a cyclohexyl group, an n-hepcyl group, an n-octyl group, a t-octyl group, 2-ethylhexyl group, an n-nonyl group, an n-decyl group, an n-dodecyl group and an n-octadecyl group, and specifically preferably a methyl group or a propyl group.

The unsubstituted aryl groups are preferably ones having 6 to 20 carbon atoms, and include, for example, a phenyl group and a naphthyl group. The groups capable of substituting onto the alkyl group and aryl groups described above include an alkyl group (for example, such as a methyl group, an n-propyl group, a t-amyl group, a t-octyl group, an n-nonyl group and a dodecyl group), an aryl group (for example, such as a phenyl group), a nitro group, a hydroxyl group, a cyano group, a sulfo group, an alkoxy group (for example, such as a methoxy group), an aryloxy group (for example, such as a phenoxy group), an acyloxy group (for example, such as a acetoxy group), an acylamino group (for example, such as an acetylamino group), a sulfonamide group (for example, such as a methanesulfonamide group), a sulfamoyl group (for example, such as a methylsulfamoyl group), a halogen atom (for example, such as a fluorine atom, a chlorine atom and a bromine atom), a carboxyl group, a carbamoyl group (for example, such as a methylcarbamoyl group), an alkoxycarbonyl group (for example, such as a methoxycarbonyl group) and a sulfonyl group (for example, such as a methylsulfonyl group). When two or more substituents thereof are present, they may be either the same or different. The total number of carbon atoms of substituted alkyl groups is preferably 1 to 20, and that of substituted aryl groups is preferably 6 to 20.

$R_2$ is preferably —$COR_3$ ($R_3$ represents an alkyl group or an aryl group) or —$CONHR_3$ ($R_3$ represents an aryl group); a, b and c are values expressed in mol % for the weights of the repeating unites; a is in a range of 40 to 86 mol %, b is in a range of 0 to 30 mol %, c is in a range of 0 to 60 mol % range, while satisfying a+b+c=100 mol %, and specifically preferably a is 50 to 86 mol %, b is 5 to 25 mol % and c is 0 to 40 mol %. Each of the repeating unit having component ratios of a, b and c may, respectively, be comprised of the same unit or of the different units.

Rolyurethane resins which can be employed in the invention have structures of such as polyester polyurethane, polyether polyurethane, polyetherpolyester polyurethane, polycarbonate polyurethane, polyesterpolycarbonate polyurethane and polycaprolactone polyurethane, which are well known in the art. In all of the polyurethanes described above, it is preferred that at least one polar group, which is selected from —COOM, —$SO_3M$, —$OSO_3M$, —P═O$(OM)_2$ (M represents a hydrogen atom or an alkali metal salt group), —$NR_2$, —$N^+R_2$ ($R^2$ represents a hydrocarbon group), an epoxy group —SH, —CN, etc., is optionally introduced by copolymerization or addition polymerization. The amount of the polar group is $10^{-1}$ to $10^{-8}$ mol/g, and preferably $10^{-2}$ to $10^{-6}$ mol/g. It is preferable to have at least one at each end of a polyurehane molecule, total of not less than two OH groups. Since OH groups form a three dimensional net structure by cross-linking with polyisocyanate as a hardener, it is preferable to have more number of OH groups in the molecule. It is specifically preferable that OH groups present at the ends of molecule because they exhibit higher reactivity with a hardener. The polyurethane is preferably provided with not less than 3 OH groups in the end of the molecule, and specifically preferably not less than 4 OH groups. When polyurethane is employed, a glass transition temperature of 70 to 105° C., a breaking elongation of 100 to 2000% and a breaking stress of 0.5 to 100 N/$mm^2$ are preferable.

The polymer compound represented by formula (V) described above of the invention can be synthesized by a general synthetic method described in such as "Vinyl Acetate Resins" edited by Ichiro Sakurada (Kobunshi Kagaku Publishing Association, 1962). Exemplary synthetic methods are listed below, however the invention is not limited by these typical examples of synthesis.

Synthetic Example 1

Synthesis of P-1

Polyvinyl alcohol manufactured by The Nippon Gosei Kagaku Kogyo Co., Ltd. (Gosenol GH18) of 20 g with 180 g of pure water was charged, dispersed in pure water to make a 10 weight % of polyvinyl alcohol solution; after polyvinyl alcohol having been dissolved by raising the temperatuere up to 95° C. it was cooled down to 75° C. to prepare a polyvinyl alcohol solution; and further to the polyvinyl alcohol solution was added 1.6 g of 10 weight % hydrochloric acid as an acid catalyst to make a dropping solution A. Successively, 11.5 g of the mixture of butylaldehyde and acetoaldehyde in a mole ratio of 1:1 was weighed to make a dropping solution B. Pure water of 100 ml was charged in a four-neck flask equipped with a cooling tube and a stirring device, heated up to 85° C., and was strongly stirred. To this were added the dropping solution A and the dropping solution B simultaneously through a dropping funnel warmed at 75° C. in 2 hours with stirring. Meanwhile, the reaction was performed with careful control of the stirring speed to prevent the precipitating particles to be coagulated by fusing. After completing the dropping, 7 g of 10 weight % hydrochloric acid as an acid catalyst was further added, and it was stirred for 2 hours at a temperature of 85° C. to perform the reaction sufficiently. Thereafter, it was cooled down to 40° C., neutralized by use of sodium bicarbonate; and after being repeatedly washed by water 5 times, the polymer was taken out by filtering and dried to obtain P-1. For obtained P-1, Tg was measured by use of DSC to be 75° C.

In addition to this, other high polymer compounds described in Table 1 were synthesized similarly. These high polymers (polymers) may be employed alone or by blending two or more kinds thereof. In the photosensitive silver salt containing layers (preferably in photosensitive layers), the polymers described above are employed as a main binder. Herein, the main binder refers to the state wherein the polymer described above occupies not less than 50 weight % of the total binder in the photosensitive silver salt containing layers. Therefor, other polymers may be employed by blending in the range of less than 50 weight % of the total binder. As these polymers, there is not particularly a limitation, provided that they are solvents in which the polymers of the invention is soluble. More preferable are included such as polyvinyl acetate, polyacryl resins and polyurethane resins.

Constitutions of high polymers according to the invention and comparative compounds are shown below. Incidentally, Tg in the table was the value measured by a differential scanning calorimeter (DSC) manufactured by Seiko Denshi Kogyo Co., Ltd.

TABLE 1

| Polymer name | Acetoacetal mol % | Butyral mol % | Acetal Mol % | Acetyl mol % | Hydroxyl group mol % | Tg value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-5 | 7 | 3 | 71.1 | 1.6 | 27.3 | 88 |
| P-6 | 10 | 0 | 73.3 | 1.9 | 24.8 | 104 |
| P-7 | 10 | 0 | 73.5 | 1.9 | 24.6 | 104 |
| P-8 | 3 | 7 | 74.4 | 1.6 | 24.0 | 75 |
| P-9 | 3 | 7 | 75.4 | 1.6 | 23.0 | 74 |
| Comp. -1 | — | — | — | — | — | 60 |
| Comp. -2 | — | — | — | — | — | 131 |

Comparison-2

Comparison-2

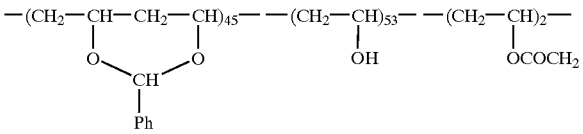

Comp.-1 in Table 1 is B-79 (manufactured by Solutia Inc.). In the invention, by employing cross-linking agents for the binders mentioned above, it is known that adhesion is improved and unevenness of development is reduced, and they are also effective to reduce fog during storage and depress printout silver generation after development.

As cross-linking agents employed in the invention are various cross-linking agents employed for conventional silver halide photographic photosensitive materials, for example, aldehyde type, epoxy type, ethyleneimine type, vinylsulfon type, sulfonate ester type, acryloyl type, carbodiimide type and silane type crosslinking agents described in JP-A 50-96216 can be employed, and preferable are the following isocyanate type compounds, silane compounds, epoxy compounds and acid anhydrides.

As one of the suitable cross-linking agents, isocyanate type and thiocyanate type cross-linking agents represented by the following formula [8] will be explained:

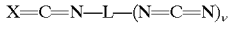

Formula [8]

wherein v is 1 or 2, L represents a connecting group which can be an alkylene, alkenylene, arylene or alkylarylene group, and X is an oxygen atom or a sulfur atom.

In the compounds represented by the formula [8], the aryl ring in an arylene group can contain substituents. Examples of suitable substituents are selected from a halogen atom (for example a bromine atom or a chlorine atom), a hydroxyl group, an amino group, a carboxyl group, an alkyl group and an alkoxy group.

The isocyanate cross-linking agents described above are isocyanate series and adducts thereof which contain at least two isocyanate groups, and, further concretely include, aliphatic diisocyanate series, an aliphatic diisocyanate series containing a cyclic group, a benzene diisocyanate series, a naphthalene diisocyanate series, a biphenyl isocyanate series, a diphenylmethane diisocyanete series, a triphenylmethane diisocyanate series, a triisocyanate series, a tetraisocyanate series, adducts of these isocyanate series, and adducts of these isocyanate series with dihydric or trihydric polyalcohols.

For example, isocyanate compounds described in JP-A 56-5535, pages 10 to 12 can be utilized.

The adducts of isocyanates with polyalcohols enhance the interlayer adhesion and exhibit superior capability of preventing, pealing-off of layers, slippage of images, and, generation of air bubbles. These isocyanates can be incorporated in any portion of photothermographic materials. For example, they can be added in a support (specifically, when the support is paper, can be contained in the sizing composition), or in any layer of photosensitive layer side of the support such as a photosensitive layer, a surface protective layer, an intermediate layer, an anti-halation layer and an under coating layer, and can be added in one or not less than two layers thereof.

Further, as thioisocyanate type cross-linking agents usable in the invention, the compounds having thioisocyanate structures corresponding to the isocyanate series described above are also useful.

The amount of the aforementioned cross-linking agents, which are employed in the invention, is 0.001 to 2 mol, and preferably in a range of 0.005 to 0.5 mol, based on 1 mol of silver.

Isocyanate compounds and thioisocyanate compounds which can be incorporated in the invention are preferably the compounds functioning as cross-linking agents described above, however, compounds with v being zero (0) in the above formula, that means even compounds having only one of the functional group, also provide good results.

Examples of silane compounds usable as cross-linking agents in the invention include compounds represented by formula (1) or (2) disclosed in Japanese Patent Application No. 2000-077904.

In these formulas, $R^1$, $R^2$, $R^3$, $R^4$, $R^5$, $R^6$, $R^7$, and $R^8$ each represent strait chain, branched or cyclic alkyl groups, which may be substituted, having 1 to 30 carbon atoms (such as a methyl group, an ethyl group, a butyl group, an octyl group, a dodecyl group and a cycloalkyl group), alkenyl groups (such as a propenyl group, a butenyl group and a nonenyl group), alkynyl groups (such as an acetylene group, a bisacetylene group and a phenylacetylene group), aryl groups or heterocyclic groups (such as a phenyl group, a naphthyl group, a tetrahydropyran group, a pyridyl group, a furyl group, a thiophenyl group, an imidazole group, a thiazole group, a thiadiazole group and an oxadiazole group), and can contain either electron attracting groups or electron releasing groups as substituents.

It is preferable that at least one substituent selected from $R^1$, $R^2$, $R^3$, $R^4$, $R^5$, $R^6$, $R^7$, and $R^8$ is a diffusion-proof group or an adsorbing group, and specifically preferable that $R^2$ is a diffusion-proof group or an adsorbing group.

Herein, a diffusion-proof group is also called as a ballast group, and is preferably an aliphatic group having not less than 6 carbon atoms or an aryl group in which an alkyl group with not less than 3 carbon atoms is introduced. The degree of diffusion-proof is varies depending on the employed amount of binders and cross-linking agents, however, the migration distance in the molecule at room temperature conditions is restrained by introducing a diffusion proof group resulting in depressed reactions at aging.

Epoxy compounds usable as cross-linking agents are ones having one or more epoxy groups, and there are no limitations with respect to the number of epoxy groups, the molecular weight and others. The epoxy groups are preferably included in a molecule as a glycidyl group through an ether bonding or an imino bonding. Further, the epoxy compounds may be any of monomers, oligomers, polymers, etc., and the number of epoxy groups being present in a molecule is generally around 1 to 10, and preferably 2 to 4. When the epoxy compound is a polymer, it may be either of a homopolymer or a copolymer, and the preferable range of the number average molecular weight Mn is around 2,000 to 20,000.

As epoxy compounds are preferable compounds represented by the following formula (9).

Formula (9)

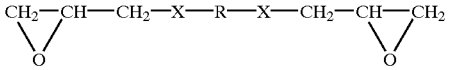

The substituent to alkylene groups represented by R in the formula (9) is preferably a group selected from a halogen atom, a hydroxyl group, a hydroxy alkyl group and an amino group. Further, in the connecting group represented by R, it is preferable to contain an amide connecting portion, an ether connecting portion or a thioether connecting portion. The divalent connecting group represented by X is preferably —$SO_2$—, —$SO_2NH$—, —S—, —O— or —NR'—. Herein, R' is a monovalent group, and preferably an electron attracting group.

These epoxy compounds may be employed alone or in combinations of two or more kinds. The addition amount is not specifically limited and preferably in a range of $1\times10^{-6}$ to $1\times10^{-2}$ mol/$m^2$, and more preferably in a range of $1\times10^{-5}$ to $1\times10^{-3}$ mol/$m^2$.

The epoxy compounds can be added in any layer of photosensitive layer side of the support such as a photosensitive layer, a surface protective layer, an intermediate layer, an anti-halation layer and an under coating layer, and can be added in one or not less than two layers thereof. Further, in addition thereto, they can be added in any layer of the opposite side of the support. In photosensitive materials having photosensitive layers on both sides, they may be added in any layer.

The acid anhydrides are the compounds containing at least one acid anhydride group represented by the following structural formula.

—CO—O—CO—

The acid anhydrides are not limited with respect to the number of acid anhydride groups, the molecular weight and others as far as having one or more of this acid anhydride group, and preferably are compounds represented by the formula (B).

Formula (B)

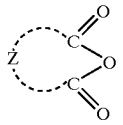

"Z" in the formula (B) represents a group of atoms necessary to form a monocyclic ring or a polycyclic ring. These rings may be unsubstituted or substituted. Examples of substituents include an alkyl group (such as methyl, ethyl and hexyl), an alkoxy group (such as methoxy, ethoxy and octyloxy), an aryl group (such as phenyl, naphthyl and tolyl), a hydroxyl group, an aryloxy group (such as phenoxy), an alkylthio group (such as methylthio and butylthio), an arylthio group (such as phenylthio), an acyl group (such as acetyl, propyonyl and butylyl), a sulfonyl group (such as methylsulfonyl and phenylsulfonyl), an acylamino group, a sulfonyl amio group, an acyloxy group (such as acetoxy and benzoxy), a carboxyl group, a cyano group, and an amino group. The substituents preferably do not contain a halogen atom.

These acid anhydrides may be employed alone or in combinations of two or more kinds. The addition amount is not specifically limited and preferably in a range of $1\times10^{-6}$ to $1\times10^{-2}$ mol/$m^2$, and more preferably in a range of $1\times10^{-5}$ to $1\times10^{-3}$ mol/$m^2$.

The acid anhydrides in the invention can be added in any layer of photosensitive layer side of the support such as a photosensitive layer, a surface protective layer, an intermediate layer, an anti-halation layer and an under coating layer, and can be added in one or not less than two layers thereof. Further, they can be added in the same layer as the epoxy compounds described above.

The silver salt photothermographic dry imaging material of the invention forms photographic images by thermal development, and preferably contains a reducible silver source (silver aliphatic carboxylates), photosensitive silver halide grains, reducing agents and optionally a tone modifier which controls silver tone generally dispersed in a (organic) binder matrix.

Examples of suitable tone modifiers are disclosed in RD 17029, U.S. Pat. Nos. 4,123,282, 3,994,732, 3,846,136 and 4,021,249. Specifically preferable tone modifiers are the combination of phthalazinone or phthalazin, and phthalic acids or phthalic anhydrides.

With respect to color tone of output images for medical diagnosis, it is said, heretofore, that images with a cold tone allow the readers of radiophotographs to obtain more accurate diagnostic observation results. Herein, a cold image tone refers to that the images are of pure black tone or of a blue-black tone in which black images have a tinge of blue. A warm image tone refers to that black images have a warm black tone with a tinge of brown.

The terms with respect to color tones: "colder tone" and "warmer tone" can be determined by a hue angle ($h_{ab}$) at a minimum density (Dmin) and an optical density of D=1.0. The hue angle $h_{ab}$ is expressed by $h_{ab}=\tan^{-1}(b^*/a^*)$, using a color coordinate a*, b* in L*a*b* color specification system defined in CIE 1976 (or JIS Z8729). L*a*b* color space was recommended by CIE (Commission Internationale de l'Eclairageto) to exhibit a uniform gradation which is similar to human visual perception.

The range of $h_{ab}$ in the invention is preferably $180°<h_{ab}<270°$, more preferably $200°<h_{ab}<270°$, and most preferably $220°<h_{ab}<260°$.

In the invention, it is preferred to incorporate a matting agent into the surface layer of the silver salt photothermographic dry imaging materials (also in case of non-photosensitive layer(s) is provided on the opposite side of the photosensitive layer placing a support between them) in respect to the handling before development and the prevention of abrasion marks after development, and the amount of the matting agent is preferably incorporated at 0.1 to 30% by weight ratio based on the binder.

The materials of matting agents preferably used in the invention may be either of organic or inorganic compounds. Examples of inorganic materials include silica described in Swiss Patent No. 330,158, glass powder described in French Patent No. 296,995, and alkaline earth metal, cadmium or zinc carbonates described in British Patent No. 1,173,181. The organic materials can include organic matting agents such as starch described in U.S. Pat. No. 2,322,037, starch derivatives described such as in Belgian Patent No. 625,451 and British Patent No. 981,198, polyvinyl alcohol described in JP-B 44-3643, polystyrene or polymethacrylate described in Swiss Patent No. 330,158, polyacrylonitrile described in U.S. Pat. No. 3,079,257, and polycarbonate described in U.S. Pat. No. 3,022,169.

The mean particle size of the matting agent is preferably 0.5 to 10 $\mu$m, and more preferably 1.0 to 8.0 $\mu$m. Further, the coefficient of variation of particle size distribution of the matting agent is preferably not more than 50%, more preferably not more than 40%, and specifically preferably not more than 30%.

The coefficient of variation of particle size distribution, herein, is the value represented by the following equation:

(Standard deviation of particle size)/(mean particle size)×100.

The adding method of the matting agent according to the invention may be one in which the matting agent is dispersed in the coating solution in advance, or one in which the matting agent is sprayed after coating the coating solution and before completion of drying. In cases when plural matting agents are added, the both methods may be used in combination.

The raw materials for a support utilized in the silver salt photothermographic dry imaging material of the invention include various kinds of high polymer materials, glass, wool cloth, cotton cloth, paper, metal (such as aluminum), etc., and suitable is materials which can be worked into flexible sheets or rolls in respect to easy handling as information recording materials. Therefore, as a support in the silver salt photothermographic dry imaging materials of the invention, are preferable plastic films (for example, such as a cellulose acetate film, a polyester film, a polyethylene terephthalate film, a polyethylene naphthalate film, a polyamide film, a polyimide film, a cellulose triacetate film or a polycarbonate film), and specifically preferable in the invention is a biaxially-stretched polyethylene terephthalate film. The thickness of a support is approximately 50 to 300 $\mu$m, and preferably 70 to 180 $\mu$m.

In the invention, electric conductive compounds such as metal oxides and/or electric conductive polymers can be incorporated in the constitution layers to improve the static charge buildup. These compounds may be incorporated in any of the constitution layers, and preferably in such as an under-coating layer, a back-coating layer and a layer between the photosensitive layer and the under-coating layer. In the invention, are preferably used electric conductive compounds described in cols. 14 to 20 of U.S. Pat. No. 5,244,773.

The silver salt photothermographic dry imaging material of the invention is provided with at least one photosensitive layer on a support. Only a photosensitive layer may be formed on a support, however, it is preferable to form at least one photo-insensitive layer on the photosensitive layer. For example, it is preferable to form a protective layer on the photosensitive layer for the purpose of protecting the photosensitive layer, and a back-coating layer on the opposite side surface of the support for the purpose of preventing adhesion between the photosensitive layers or in rolls of the photosensitive materials. As binders employed in these protective layer and back-coating layer, polymers, which have a higher glass transition temperature than that of the thermally developable layer and are hard to produce abrasion marks or deformation, for example, such as cellulose acetate and cellulose acetate-butylate, are selected from binders described above. Incidentally, for contrast control and the like, not less than two layers on one side of the support or not less than one layer on both sides of the support may be provided.

In the silver salt photothermographic dry imaging material of the invention, in order to control the amount or wavelength distribution of light transmitting through the photosensitive layer, it is preferable to provide a filter layer on the same side as or the opposite side to the photosensitive layer, or to incorporate dyes or pigments in the photosensitive layer.

As dyes employed, compounds well known in the art, which absorb light of various wavelength regions, can be utilized corresponding to the spectral sensitivity of the photosensitive material.

For example, when the silver salt photothermographic dry imaging material of the invention is utilized as an image recording material by infrared light, squarylium dyes having a thiopyrylium nuclear (in this description, refers to as thiopyrylium squarylium dyes), squarylium dyes having a pyrylium nuclear (in this description, refers to as pyrylium squarylium dyes), thiopyryliumcroconium dyes which are similar to squarylium dyes and pyrylium croconium dyes, such as disclosed in Japanese Patent Application 11-255557 are preferably employed.

Herein, compounds having a squarylium nuclear refers to compounds having 1-cyclobutene-2-hydroxy-4-one in the molecular structure, and compounds having a croconium nuclear refers to compounds having 1-cyclopentene-2-hydroxy-4,5-dione in the molecular structure. Wherein, the hydroxyl group may be dissociated. Hereinafter, in the invention these dyes in the lump are called as squarylium dyes for convenience.

Further, as dyes also preferable are compounds of JP-A 8-201959.

The silver salt photothermographic dry imaging material of the invention is preferably formed, by preparing coating solutions, in which materials of each constitution layer mentioned above are dissolved or dispersed in solvents, and by simultaneously coating pluralities of the coating solutions, followed by heat process. Herein, "simultaneously coating" means that coating solutions of respective constitution layers (such as a photosensitive layer or a protective layer) are prepared and the coating solutions are coated on a support in such a manner that the coating solutions are simultaneously coated and the drying process is also simultaneously performed to form the constitution layers, instead of repeating coating and drying for each constitution layer. In other words, it means that the upper layer is applied before the remaining amount of total solvent in the underlying layer becomes not more than 70%.

The method for simultaneously coating constitution layers is not specifically limited, and, for example, methods well known in the art such as a bar coating method, a curtain coating method, a dipping method, an air-knife method, a hopper coating method and an extrusion coating method can be utilized. Among these, more preferable is a premeasuring type coating method called as an extrusion coating method. Since the extrusion coating method causes no vaporization on the slide surface in the slide coating method, it is suitable for accurate coating and organic solvent coating. The coating method has been described with respect to the photosensitive layer side, however, it is similarly performed in the case of coating a back coating layer together with an under coating layer.

In the invention, the coating amount of silver is suitably selected according to the purpose of silver salt photothermographic dry imaging materials, and in the case of the purpose being for medical diagnostic images, it is preferably not less than 0.6 g/m$^2$ and not more than 2.5 g/m$^2$. It is more preferably not less than 1.0 g/m$^2$ and not more than 1.7 g/m$^2$. The portion arising from silver halide among the coating amount of silver comprises preferably 2 to 18%, and, further, more preferably 3 to 15%, based on the total silver amount.

Further, in the invention, the coating density of silver halide grains having not less than 0.01 $\mu$m (sphere equivalent diameter of grain size) is preferably not less than $1\times10^{14}$ grains/m$^2$ and not more than $1\times10^{18}$ grains/m$^2$, and more preferably not less than $1\times10^{15}$ grains/m$^2$ and not more than $1\times10^{17}$ grains m$^2$.

Further, the coating density of silver aliphatic carboxylates of the invention is preferably not less than $10^{-17}$ g and not more than $10^{-15}$ g, and more preferably not less than $10^{-16}$ g and not more than $10^{-14}$ g, per grain having a grain size of not less than 0.01 $\mu$m (sphere equivalent diameter).

When being coated in the range described above, preferable results are obtained in respect of the maximum optical density of silver images per a given silver coating amount (namely, covering power) and color tone of silver images.

In the invention, development conditions vary depending on instruments, equipment or means, and typically accompany heating of the image-wise exposed silver salt photothermographic dry imaging material at a suitable high temperature. Latent images obtained after exposure can be developed by heating the silver salt photothermographic dry imaging material at a moderately high temperature (for example, at approximately 80 to 200° C., and preferably at approximately 100 to 200° C.) for sufficient time duration (for example, for approximately 1 second to 2 minutes, and preferably for 5 to 50 seconds). At a heating temperature lower than 80° C., a sufficient image density cannot be obtained in short time; and at a heating temperature higher than 200° C., binders may fuse and, by such as being transferred to rolls, cause bad effects not only on images themselves but also on the transportation performance or the development equipment. Silver images are formed as a result of an oxidation-reduction reaction between silver aliphatic carboxylates (which function as an oxidant) and reducing agents by heating. This reaction process proceeds without any supply of processing solutions such as water from the outside.

Instruments, equipment or means for heating may be provided by typical heating means utilizing such as a heat plate, an iron, a hot roll, carbon or white titanium as a heat generator. More preferably, the silver salt photothermographic dry imaging material provided with a protective layer of the invention is preferably subjected to heating by contacting the surface having a protective layer with a heating mean in respect to homogeneous heating, as well as thermal efficiency and working property, and preferably developed by being transported contacting the surface with a heat roll.

Exposure of the silver salt photothermographic dry imaging material of the invention is performed preferably by employing a suitable light source corresponding to the spectral sensitivity of the photosensitive material. For example, when the photosensitive material is sensitive to infrared light, any light source as far as being in an infrared light region may be utilized, however, an infrared semiconducter laser (780 nm, 820 nm) is more preferably employed because the laser power is high and the photosensitive material can be made transparent.

In the invention, exposure is preferably performed by laser scanning exposure, and various kinds of methods can be employed as the exposure method. For example, the first preferable method includes one utilizing a laser scanning exposure apparatus in which the angle between the exposure surface of the photosensitive material and the scanning laser light does not substantially become perpendicular.

Herein, "does not substantially become perpendicular" refers to being not less than 55° and not more than 88°, more preferably not less than 60° and not more than 86°, furthermore preferably not less than 65° and not more than 84°, and most preferably not less than 70° and not more than 82°.

The beam spot diameter of laser light, when it is scanned on the photosensitive material, is preferably not more than 200 μm, and more preferably not more than 100 μm. The smaller the diameter of laser spot, the more preferable it is in respect to being able to reduce the deviation of the laser incident angle from perpendicular. Incidentally, the under limit of the diameter of a laser beam spot is 10 μm. By such laser scanning exposure, it is possible to reduce the deterioration of images with respect to reflecting light such as a formation of unevenness by interference fringes.

Further, as the second method, it is also preferable to perform exposure in the invention by the-use of a laser scanning exposure apparatus which emits scanning laser light of longitudinally multiple. Compared to scanning laser light of longitudinally single mode, deterioration of images such as a formation of unevenness by interference fringes can be reduced.

To be made longitudinally multiple, methods such as utilizing return light by wave combination and putting on high frequency accumulation are preferred. Wherein, longitudinally multiple means the exposure wavelengths are not single, and the distribution of exposure wavelengths is generally not less than 5 nm, and preferably not less than 10 nm. There is specifically no upper limitation with the distribution of exposure wavelengths, however it is generally approximately 60 nm.

As lasers employed for the scanning exposure in the first and second embodiments of image recording methods described above, solid lasers such as a ruby laser, an YAG laser and a glass laser; gas lasers such as a HeNe laser, an Ar ion laser, a Kr ion laser, a $CO_2$ laser, a CO laser, a HeCd laser, a $N_2$ laser and an eximer laser; semiconductor lasers such as an InGaP laser, a AlGaAs laser, a GaAsP laser, an InGaAs laser, an InAsP laser, a $CdSnP_2$ laser and a GaSb laser; chemical lasers, and dye lasers, which are commonly well known can be employed by being suitably selected according to the application purposes, and among these preferable are semiconductor lasers having wavelength of 600 to 1,200 nm in respect to maintenance and size of light sources. Further, in lasers utilized for laser imagers and laser image setters, the beam spot diameter, being scanned onto a silver salt photothermographic dry imaging material, at the exposure surface of the photosensitive material is generally in the range of 5 to 75 μm as a short axial diameter and 5 to 100 μm as a long axial diameter, and the laser scanning speed can be set at an optimum value for each photosensitive material depending on inherent sensitivity of a silver salt photothermographic dry imaging material at laser oscillation wavelengths and laser power.

EXAMPLES

The invention will be detailed according to examples below, however, the invention is not limited thereto.

Example 1

Preparation of Photographic Support

On one side of a polyethylene terephthalate film base (thickness of 175 μm) which was blue colored at a density of 0.170, after being subjected to a corona discharge treatment of 0.5 kV·A·min/m$^2$, the under-coating layer was coated thereon by use of the following under-coating layer coating solution A so as to make the dry film thickness 0.2 μm. Further, on the other side of the support, similarly, after being subjected to a corona discharge treatment of 0.5 kV·A·min/m$^2$, the under-coating layer b by use of the following under-coating layer coating solution B was coated thereon so as to make the dry film thickness 0.1 μm. Thereafter, it was heat processed at 130° C. for 15 min., in heating type oven equipped with a film transport apparatus comprised of plural roll groups.

Under-coating Layer Coating Solution A

A coplymer latex solution (solid content: 30%) of 270 g, comprised of 30 weight % of n-butylacrylate, 20 weight % of t-butylacrylate, 25 weight % of styrene and 25 weight % of 2-hydroxyethylacrylate; 0.6 g of a surfactant (UL-1) and 0.5 g of methylcellulose were mixed. Furthere, a dispersion solution, in which 1.3 g of silica particles (Siloide 350, manufactured by Fuji Silicia Co.) was added to 100 g of water, being subjected to a dispersion process by use of an ultrasonic dispersion device (Ultrasonic Generator, manufactured by ALEX Corp., frequency: 25 kHz, 600 W) for 30 min., was added thereto, and finally, the mixture was made to 1000 ml by water to prepare the under-coating layer coating solution A.

Preparation of Colloidal Tin Oxide Dispersion

Stannic chloride hydrate of 65 g was dissolved in 2000 ml of water/ethanol mixed solution to make a homogeneous solution. Subsequently, this was boiled to obtain a co-precipitate. The thus formed precipitates were taken out by decantation, and washed by distilled water a few times. After confirming that there was no reaction of a chlorine ion by dropping silver nitrate into the water having been used for washing the precipitate, distilled water was added to the washed precipitate to make the total volume 2000 ml. Further, 40 ml of 30% ammonia water was added, and by heating the aqueous solution to concentrate the volume to become 470 ml, a colloidal tin oxide dispersion solution was prepared.

Under-coating Layer Coating Solution B

The colloidal tin oxide dispersion solution described above of 37.5 g, 37 g of a coplymer latex solution (solid content: 30%), comprised of 20 weight % of n-butylacrylate, 30 weight % of t-butylacrylate, 27 weight % of styrene and 28 weight % of 2-hydroxyethylacrylate; 14.8 g of a copolymer latex solution (solid content: 30%), comprised of 40 weight % of n-butylacrylate, 20 weight % of styrene and 40 weight % of glycidyl methacrylate; and 0.1 g of a surfactant (UL-1) were mixed, and it was made to 1000 ml by water to prepare the under-coating layer coating solution B.

UL-1

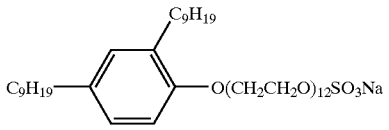

Back Coating

Cellulose acetate butylate (Eastman Chemical Co., CAB381-20) of 84.2 g and 4.5 g of a polyester resin (Bostic Co., Vitel PE2200B) were added into 830 g of methyl ethyl ketone (MEK) with stirring, and dissolved. Next, 0.30 g of Infrared. Dye 1 was added, further, were added 4.5 g of a F-type surfactant (Asahi Glass Co., Ltd., Surflon KH40) and 2.3 g of a F-type surfactant (Dainippon Ink & Chemicals Inc., Megafagg F120K) dissolved in 43.2 g of methanol, and they were stirred sufficiently until being dissolved. Finally, 75 g of silica (W.R. Grace Co., Siloide 64X6000) which was dispersed in methyl ethyl ketone at a concentration of 1 weight % by use of a dissolver type homogenizer was added and stirred to prepare a coating solution for the back side.

Infrared Dye 1

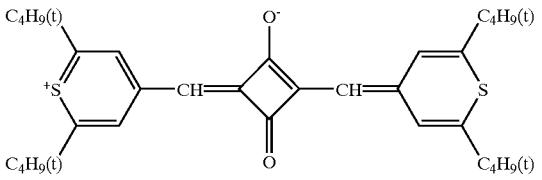

The back coating solution thus prepared was coated by an extrusion coater and dried so as to make the dry film thickness 3.5 μm. The drying was carried out at a temperature of 100° C., employing drying air having a dew point of 10° C., for 5 min.

Preparation of Photosensitive Silver Halide Emulsion A

| | |
|---|---|
| A1 | |
| Phenylcarbamoyl modified gelatin | 88.3 g |
| Compound (A) (10% methanol aqueous solution) | 10 ml |
| Potassium bromide | 0.32 g |
| Water to make 5429 ml | |
| B1 | |
| 0.67 mol/L silver nitrate solution | 2635 ml |
| C1 | |
| Potassium bromide | 51.55 g |
| Potassium iodide | 1.47 g |
| Water to make 660 ml | |
| D1 | |
| Potassium bromide | 154.9 g |
| Potassium iodide | 4.41 g |
| Iridium chloride (1% solution) | 0.93 ml |
| Water to make 1982 ml | |
| E1 | |
| 0.4 mol/L potassium bromide aqueous solution an amount for controlling latter mentioned silver potential | |
| F1 | |
| Potassium hydroxide | 0.71 g |
| Water to make 20 ml | |
| G1 | |
| 56% acetic acid aqueous solution | 18.0 ml |
| H1 | |
| Sodium carbonate anhydrous | 1.72 g |
| Water to make 151 ml | |
| Compound (A): | |
| $HO(CH_2CH_2O)_n(CH(CH_3)CH_2O)_{17}(CH_2CH_2O)_mH$ | (m + n = 5 to 7) |

Employing a mixing stirrer described in JP-B 58-58288 and 58-58289, added to Solution (A1) were ¼ Solution (B1) and total Solution (C1) over 4 minutes 45 seconds utilizing a double-jet method, while adjusting the temperature to 45° C. and pAg to 8.09, whereby nuclei were formed. After 1 minute, all of Solution (F1) was added, while the pAg was suitably adjusted employing Solution (E1). After 6 minutes, added to the resulting mixture were ¾ of Solution (B1) and all of Solution (D1) over 14 minutes 15 seconds employing a double-jet method, while adjusting the temperature to 45° C. and pAg to 8.09. After the solution was stirred for 5 minutes, it was cooled to 40° C. Subsequently, to the resulting mixture was added all of Solution (G1), whereby a silver halide emulsion grains were sedimented. The resulting supernatant was then removed while leaving 2000 ml of the resulting precipitation to which 10 liters of water was added. After stirring, silver halide emulsion was precipitate again. Subsequently, the resulting supernatant was removed while leaving 1,500 ml of the sedimented portion, to which further 10 liters of water was added. After stirring, silver halide emulsion was sedimented. Thereafter, the resulting supernatant was removed while leaving 1,500 ml of the sedimented portion, to which Solution (H1) was added and the resulting mixture was heated to 60° C. and stirred for further 120 minutes. Finally, the pH was adjusted to 5.8 and water was added so as to obtain a total weight of 1,161 g per mol of silver, whereby an emulsion was prepared.

The emulsion was comprised of monodisperse cubic silver iodobromide grains having an average grain size of 0.058 μm, a variation coefficient of grain size of 12%, and a [100] face ratio of 92%.

Next, 240 ml of a sulfur sensitizer S-5 (0.5% methanol solution) was added to the above emulsion, and further thereto was added 1/20 equivalent mol, based on the sensitizer, of an gold sensitizer Au-5, to perform chemical sensitization with stirring at 55° C. for 120 minutes. Thereby, photosensitive silver halide emulsion A was obtained.

Preparation of Photosensitive Silver Halide Emulsion B

An emulsion was prepared in a similar manner to photosensitive silver halide emulsion A, except that the temperature at the nucleation stage was varied to 39° C. and the temperature during the time when ¾ of Solution (B1) and all of Solution (D1) were added was varied to 39° C. The resulting emulsion was comprised of monodisperse cubic silver iodobromide grains having an average grain size of 0.053 μm, a variation coefficient of grain size of 12%, and a [100] face ratio of 92%. The emulsion was subjected to chemical sensitization in a similar manner to photosensitive silver halide emulsion A described above.

Preparation of Photosensitive Silver Halide Emulsion C

An emulsion was prepared in a similar manner to photosensitive silver halide emulsion A, except that the temperature at the nucleation stage was varied to 30° C. and the temperature during the time when ¾ of Solution (B1) and all of Solution (D1) while their addition were varied to 30° C. The resulting emulsion was comprised of monodisperse cubic silver iodobromide grains having an average grain size of 0.040 μm, a variation coefficient of grain size of 12%, and a [100] face ratio of 92%. The emulsion was subjected to chemical sensitization in a similar manner to photosensitive silver halide emulsion A described above.

Preparation of Powdery Silver Aliphatic Carboxylates A to C

Dissolved in 4,720 ml of pure water were 130.8 g of behenic acid, 67.7 g of arachidic acid, 43.6 g of stearic acid and 2.3 g of palmitic acid at 80° C. Subsequently, added to the resulting mixture were 540.2 ml of a 1.5 M aqueous sodium hydroxide solution and 6.9 ml of concentrated nitric acid, and the resulting mixture was then cooled to 55° C., whereby a fatty acid sodium salt was prepared. While maintaining the temperature of the fatty acid sodium salt solution at 55° C., 45.3 g of the photosensitive silver halide emulsion A and 450 ml of pure water were added and stirred for 5 minutes.

Subsequently, 702.6 ml of 1 M silver nitrate solution were added over 2 minutes and the resulting mixture was stirred for 10 minutes, whereby an silver aliphatic carboxylate dispersion was prepared. Thereafter, the prepared silver aliphatic carboxylate dispersion was placed into a washing vessel. After adding deionized water while stirring, the resulting dispersion was allowed to stand so that the silver aliphatic carboxylate dispersion was separated as suspended solids and the lower water-soluble salts were removed. The thus obtained silver aliphatic carboxylate was repeatedly washed with deionized water and drained until the electric conductivity of the drainage reached 50 μS/cm, and then dehydrated by centrifuge. The resulting silver aliphatic carboxylate cake was dried employing a flash dryer (Flash Jet Dryer, manufactured by Seishin Kigyo Co., Ltd.), under the operating conditions of a nitrogen gas atmosphere and hot-air at the dryer inlet, until the moisture content reached 0.1%, whereby powdery silver aliphatic carboxylate A was prepared. The moisture content of silver aliphatic carboxylate composition was measured by an infrared moisture meter.

Powdery silver aliphatic carboxylates B and C were similarly prepared, except that photosensitive silver halide emulsions B and C were employed instead of photosensitive silver halide emulsion A.

Preparation of Preliminary Dispersions A to C

Dissolved in 1,457 g of methyl ethyl ketone were 14.57 g of polyvinylbutyral resin (B-75, produced by SORCIA Co.). Subsequently, preliminary dispersion A was prepared by gradually adding 500 g of powdery silver aliphatic carboxylate A while being sufficiently stirred employing a dissolver (DISPERMAT Type CA-40M, produced by VMA-GETZMANN Co.).

Preliminary dispersions B and C were similarly prepared, except that powdery silver aliphatic carboxylates B and C were employed instead of powdery silver aliphatic carboxylate A.

Preparation of Photosensitive Emulsified Dispersions A to C

Employing a pump, preliminary dispersion A was supplied into a media type homogenizer, Dispermat Type SL-C12EX (produced by VMA-Getzmann Co.), filled with 0.5 mm diameter zirconia beads (Torayselam, produced by Toray) in an amount of 80% of the interior volume, so as to achieve a retention time in the mill of 1.5 minutes, and was dispersed at a circumferential speed of the mill of 8 m/second, whereby photosensitive emulsified dispersion A was prepared.

Photosensitive emulsified dispersions B and C were prepared in a quite similar manner to Photosensitive Emulsion Dispersion Solution A, except that Preliminary Dispersions B and C were employed instead of Preliminary Dispersion A.

Preparation of Stabilizer Solution

A stabilizer solution was prepared by dissolving 1.0 g of stabilizer 1 and 0.31 g of potassium acetate in 4.97 g of methanol.

Preparation of Infrared Sensitizing Dye Solution A

Infrared sensitizing dye solution A was prepared by dissolving in a dark place 19.2 mg of infrared sensitizing dye 1, 1.488 g of 2-chloro-benzoic acid, 2.779 g of stabilizer 2 and 365 mg of 5-methyl-mercaptobenzimidazole in 31.3 ml of MEK.

Preparation of Additive Solution (a)

Additive solution (a) was prepared by dissolving 27.98 g of 1-bis(2-hydroxy-3,5-dimethylphenyl)-2-methylpropane as a developer, 1.54 g of methylphthelic acid and 0.48 g of infrared sensitizing dye 1 described above in 110 g of MEK.

Preparation of Additive Solution (b)

Additive Solution (b) was prepared by dissolving 3.56 g of antifoggant 2 and 3.43 g of phthalazine in 40.9 g of MEK.

Preparation of Photosensitive Layer Coating Solution A

To 50 g of photosensitive emulsified dispersion A and 15.11 g of MEK, 390 μl of Antifoggant 1 (10% methanol solution) was added with stirring at 21° C. under an inert gas atmosphere (comprising 97% nitrogen gas), and stirring continued for 1 hour. Further, 494 μl of calcium bromide (10% methanol solution) was added and stirred for 20 minutes. Subsequently, after adding 167 ml of the stabilizer solution and stirring for 10 minutes, 1.32 g of the infrared sensitizing dye solution was added and stirred for one hour. Thereafter, the resulting mixture was cooled to 13° C. and stirred further for 30 minutes. While maintaining at 13° C., 13.31 g of polyvinylbutyral resin (B-79, produced by SORCIA Co.) was added and stirred for 30 minutes. Thereafter, 1.084 g of tetrachlorophthalic acid (being a 9.4 weight % MEK solution) was added and stirred for 15 minutes. Further while stirring, 12.43 g of additive solution (a), 1.6 ml of Desmodur N3300 (aliphatic isocyanate, manufactured by Mobey Co., 10% MEK solution), and 4.27 g of additive solution (b) were successively added and stirred, whereby photosensitive layer coating solution A was prepared.

Preparation of Matting Agent Dispersion

A matting agent dispersion was prepared as described below. Dissolved in 42.5 g of MEK was 7.5 g of cellulose acetate butyrate (CAB 171-15, manufactured by Eastman Chemical Co.), followed by the addition of 5 g of calcium carbonate (Super-Pflex 200, manufactured by Speciality Minerals Co.). The resulting mixture was then dispersed at 8,000 rpm for 30 minutes, employing a dissolver type homogenizer.

Preparation of Surface Protective Layer Coating Solution

While stirring, added to and dissolved in 865 g of MEK (methyl ethyl ketone) were 96 g of cellulose acetate butyrate (CAB 171-15, manufactured by Eastman Chemical Co.), 4.5 g of polymethyl methacrylic acid (Palaroid A-21, manufactured by Rhom & Haas Co.), 1.5 g of a vinylsulfon compound (VSC), 1.0 g of benzotriazole and 1.0 g of fluorinated surface active agent (Surfron KH40, manufactured by Asahi Glass Co.). Subsequently, 30 g of the matting agent dispersion described above were added to the resulting solution and stirred to prepare a surface protective layer coating composition.

S-5

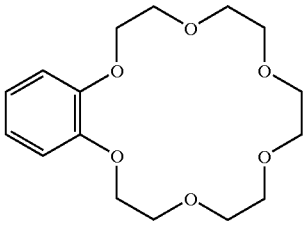

Au-5

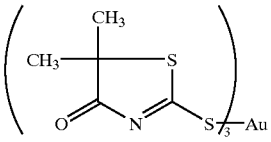

Stabilizer 1

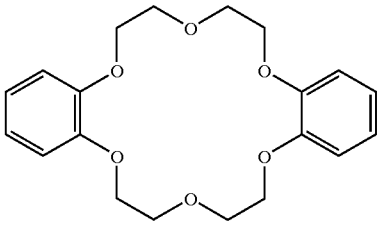

Antifoggant 1

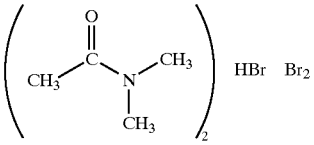

Stabilizer 2

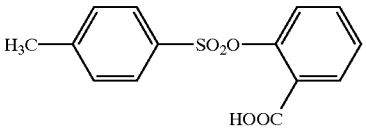

Antifoggant 2

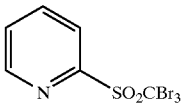

-continued

VSC

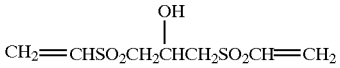

Infrared Sensitizing Dye 1

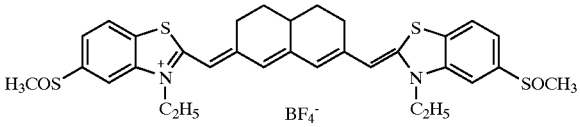

Preparation of Silver Salt Photothermographic Dry Imaging Material Sample 101

Sample 101 was prepared by simultaneously coating photosensitive layer coating solution A and the surface protective layer coating solution employing a commonly known extrusion type coater. The coating was performed so as to make the coated silver amount 1.5 g/m$^2$ and the dry film thickness of surface protective layer 2.5 $\mu$m. Thereafter, the resulting coat was dried for 10 minutes, employing 75° C. hot air at a dew point temperature of 10° C.

Samples 102 to 109 were prepared in a similar manner to Sample 101, except that photosensitive emulsified dispersions and binders in the photosensitive layer coating solutions were varied, as shown in Table 2.

Exposure and Development

The thus prepared samples were subjected to exposure from the emulsion surface side by means of laser scan employing an exposure apparatus provided with a semiconductor laser, as a light source, which was made to be longitudinal multi-mode at the wavelengths of 800 to 820 nm by high frequency accumulation. Herein, images were formed adjusting the angle between the exposed surface of samples and the exposing laser light beam to 75 degrees. (Images with minimized non-uniformity and unexpectedly superior sharpness were obtained, comparing to the case of the angle being 90 degrees.)

Thereafter, the samples were developed at 110° C. for 15 seconds utilizing an automatic developing apparatus equipped with a heat drum, while bringing the exposed sample surface into contact with the drum surface. The exposure and the development were performed in a room conditioned at 23° C. and 50% RH. The obtained images were evaluated by a densitometer. The measured results were evaluated with respect to sensitivity (which was represented by the reciprocal of exposure giving a density of 1.0 above the unexposed area), fog and maximum density, and the sensitivity and maximum density were each represented by a relative value, based on those of sample 101 each being 100, as shown in Table 2.

Measurement of Variation Rate of Fog Density

Samples which were thermally processed similarly to the foregoing sensitometry were continuously exposed to light in an atmosphere at 45° C. and 55% RH for 3 days, in which commercially available white fluorescent lamp was arranged so as to exhibit an illumination intensity of 500 lux on the surface of each sample. Thereafter, exposed and unexposed samples were measured for the minimum density, and the rate of variation in fog density (hereinafter, also denoted as variation rate of fog density) was determined in accordance with the following equation 1:

$$\text{Variation rate of fog density}=(D_2-D_1)/D_1\times 100(\%)$$

wherein $D_{fog\ 1}$ represents the minimum density of a sample unexposed to fluorescent lamp light and $D_{fog\ 2}$ represents the minimum density of a sample exposed to fluorescent lamp light.

Measurement of Thermal Transition Temperature

After a photosensitive layer coating solution and a surface protective layer coating solution having the same compositions as described above were respectively coated on a Teflon plate by employing a wire bar under the same condition as described above and dried, and after similarly exposed and developed so as to give the maximum density, the constitution layers coated were peeled off from the Teflon plate. Approximately 10 mg of the peeled sample was charged in an aluminum pan, and the thermal transition temperature of each sample was measured according to JIS K7121 employing a differential scanning type calorimeter (EXSTAR6000, produced by Seiko Denshi Co.). In the measurement, the temperature was raised at a rate of 10° C./min from 0 to 200° C. and was lowered at a rate of 20° C./min for cooling to 0° C., and thermal transition temperatures were determined by repeating this operation twice.

Evaluation of Image Lasting Quality

Thermally developed samples were prepared in a similar manner to those used for the measurement of the variation rate of fog density described above and were allowed to stand under the environment at 25° C. or 45° C. for 3 days, thereafter, the variation of maximum density was measured and the variation rate of the maximum density was determined according the following equation and evaluated as a measure of image retention quality.

Image density variation rate=(maximum density of 45° C.–stored sample)/(maximum density of 25° C.–stored sample)×100(%)

<Evaluation of Aging Stability>

Samples were stored for 10 days under each of the following two conditions and after exposed and developed in the same manner as in the sensitometry described earlier, sensitometry of the thus obtained images was performed to determine the ratio of sensitivity obtained at Condition B that obtained at Condition A according to the following equation, which was evaluated as a measure of aging stability.

Condition A: 25° C., 55% RH

Condition B: 40° C., 80% RH

Variation rate of sensitivity=(sensitivity obtained at Condition A)/(sensitivity obtained at Condition B)×100(%)

Measurement of Hue Angle

A hue angle ($h_{ab}$) was determined by measuring a minimum density area and an area having an optical density of 1.0 in the developed sample, by employing D65 as a common light source for colorimetry and utilizing spectral calorimeter CM-508d (produced by Minolta Co.) at a viewing angle of 2°. The common light source D65 is determined by CIE.

TABLE 2

| Sample | Photo-sensitive emulsified dispersion | Photo-sensitive layer Binder | Tr* | Fog density | Relative sensi-tivity | Maximum density | Fog density variation rate (%) | Image lasting quality (%) | Aging stability (%) | Remark |
|---|---|---|---|---|---|---|---|---|---|---|
| 101 | A | Comp. −1 | 43 | 0.240 | 100 | 100 | 54 | 78 | 84 | Comp. |
| 102 | A | P-2 | 54 | 0.235 | 98 | 102 | 38 | 79 | 85 | Comp. |
| 103 | B | Comp. −1 | 43 | 0.230 | 103 | 98 | 40 | 76 | 82 | Comp. |
| 104 | B | p-2 | 54 | 0.224 | 120 | 118 | 23 | 97 | 99 | Inv. |
| 105 | B | p-5 | 50 | 0.220 | 118 | 115 | 25 | 98 | 98 | Inv. |
| 106 | B | p-6 | 55 | 0.223 | 122 | 114 | 24 | 98 | 98 | Inv. |
| 107 | C | p-2 | 54 | 0.209 | 130 | 124 | 18 | 97 | 96 | Inv. |
| 108 | C | p-5 | 50 | 0.205 | 127 | 125 | 20 | 96 | 97 | Inv. |

*Thermal transition point (° C.)

As is apparent from Table 2, silver salt photothermographic dry imaging material samples according to the invention exhibited low fog and high sensitivity as well as superior image lasing quality and aging stability, compared to the comparative samples. It was further proved that the inventive samples exhibited a hue angle value of more than 180° and less than 270°, resulting in a blue black tone image, which is a suitable output as diagnostic images.

Example 2

A silver salt photothermographic dry imaging material was prepared in a similar manner to Example 1, except that the followings described below.

Preparation of Powdery Silver Aliphatic Carboxylate D

Dissolved in 4,720 ml of pure water were 104.6 g of behenic acid, 54.2 g of arachidic acid, 34.9 g of stearic acid and 1.8 g of palmitic acid at 80° C. Subsequently, added to the resulting mixture were 432.2 ml of a 1.5 M aqueous sodium hydroxide solution and 5.5 ml of concentrated nitric acid, and the resulting mixture was then cooled to 55° C., whereby a fatty acid sodium salt was prepared. While maintaining the temperature of the fatty acid sodium salt solution at 55° C., 36.2. g of the Photosensitive Silver Halide Emulsion A and 450 ml of pure water were added and stirred for 5 minutes.

Subsequently, 562.1 ml of 1 M silver nitrate solution were added over 2 minutes and the resulting mixture was stirred for 10 minutes, whereby an silver aliphatic carboxylate dispersion was prepared. As for following processes, powdery silver aliphatic carboxylate A of Example 1.

Preparation of Powdered Silver Aliphatic Carboxylate E

Dissolved in 4,720 ml of pure water were 130.8 g of behenic acid, 67.7 g of arachidic acid, 43.6 g of stearic acid and 2.3 g of palmitic acid at 80° C. Subsequently, added to the resulting mixture were 540.2 ml of a 1.5 M aqueous sodium hydroxide solution and 6.9 ml of concentrated nitric acid, and the resulting mixture was then cooled to 55° C., whereby a fatty acid sodium salt was prepared. While maintaining the temperature of the fatty acid sodium salt solution at 55° C., after 347 ml of t-butyl alcohol was added and stirred for 20 minutes, 45.3 g of the photosensitive silver halide emulsion A and 450 ml of pure water were added and stirred for 5 minutes.

Subsequently, powdery silver aliphatic carboxylate E was prepared in a similar manner to powdered silver aliphatic carboxylate A of Example 1.

Preparation of Powdered Silver Aliphatic Carboxylate F

Dissolved in 4,720 ml of pure water were 130.8 g of behenic acid, 67.7 g of arachidic acid, 32.2 g of stearic acid, 2.3 g of palmitic acid and 17.0 g of isoarachidic acid at 80° C. Subsequently, added to the resulting mixture were 540.2 ml of a 1.5 M aqueous sodium hydroxide solution and 6.9 ml of concentrated nitric acid, and the resulting mixture was then cooled to 55° C., whereby a fatty acid sodium salt was prepared. While maintaining the temperature of the fatty acid sodium salt solution at 55° C., 45.3 g of the photosensitive silver halide emulsion A and 450 ml of pure water were added and stirred for 5 minutes.

Subsequently, powdery silver aliphatic carboxylate F was prepared in a similar manner to powdery silver aliphatic carboxylate A of Example 1.

Preparation of Powdered Silver Aliphatic Carboxylate G

Dissolved in 4,720 ml of pure water were 130.8 g of behenic acid, 67.7 g of arachidic acid, 37.6 g of stearic acid, 2.3 g of palmitic acid and 6.0 g of oleic acid at 80° C. Subsequently, added to the resulting mixture were 540.2 ml of a 1.5 M aqueous sodium hydroxide solution and 6.9 ml of concentrated nitric acid, and the resulting mixture was then cooled to 55° C., whereby a fatty acid sodium salt was prepared. While maintaining the temperature of the fatty acid sodium salt solution at 55° C., 45.3 g of the photosensitive silver halide emulsion A and 450 ml of pure water were added and stirred for 5 minutes.

Subsequently, powdered silver aliphatic carboxylate G was prepared in a similar manner to powdered silver aliphatic carboxylate A of Example 1.

Preparation of Powdered Silver Aliphatic Carboxylate H

Dissolved in 4,720 ml of pure water were 130.8 g of behenic acid, 67.7 g of arachidic acid, 43.6 g of stearic acid, 2.3 g of palmitic acid and 1.5 g of polyvinyl alcohol (PVA-205, manufactured by Kuraray Co., Ltd.) at 80° C. Subsequently, added to the resulting mixture were 540.2 ml of a 1.5 M aqueous sodium hydroxide solution and 6.9 ml of concentrated nitric acid, and the resulting mixture was then cooled to 55° C., whereby a fatty acid sodium salt was prepared. While maintaining the temperature of the fatty acid sodium salt solution at 55° C., 45.3 g of the photosensitive silver halide emulsion A and 450 ml of pure water were added and stirred for 5 minutes.

Subsequently, powdery silver aliphatic carboxylate H was prepared in a similar manner to powdery silver aliphatic carboxylate A of Example 1.

Preparation of Preliminary Dispersions D to H

These were prepared in a similar manner to Example 1, except that the powdery silver aliphatic carboxylates were replaced by each of carboxylates D to H.

Preparation of Photosensitive Emulsion Dispersions D to H

These were prepared in a similar manner to Example 1, except that the preliminary dispersion was replaced by each of dispersions D to H.

Preparation of Photosensitive Layer Coating Solution D

Photosensitive layer coating solution D was prepared in a similar manner to photosensitive layer coating solution A of Example 1, employing photosensitive emulsion dispersion D.

Preparation of Silver Salt Photothermographic Dry Imaging Material Sample 201

Sample 201 was prepared in a similar manner to Example 1, employing photosensitive layer coating solution D and the surface protective layer coating solution of Example 1.

Samples 202 to 208 were prepared in a similar manner to Sample 201, except that photosensitive emulsion dispersions and binders in photosensitive layer coating solutions were replaced by each of those described in Table 3.

Measurement of Grain Size and Thickness of Silver Aliphatic Carboxylate

The dispersed silver aliphatic carboxylate, diluted and dispersed onto a grid fitted with a carbon supporting film, and photographed at a direct magnification by a factor of 5,000, employing transmission type electron microscope (2000FX type, produced by Nippon Denshi). The negative image was converted to a digital image employing a scanner, the grain size of 300 grains were measured by an image processor LUZEX III (produced by Nikore Co.), and the average value thereof was determined.

Next, to obtain the thickness, the photosensitive layer coated on the support was adhered onto a holder employing an adhesive. Subsequently, employing a diammond knife, 0.1 to 0.2 μm ultra-thin slices were prepared by cutting vertically to the support surface, employing a diammond knife. The prepared ultra-thin slice was held employing a copper mesh, and was transferred onto the carbon film, surface hydrophilicity of which was previously enhanced by subjecting to the glow discharge. Thereafter, while being cooled at −130° C. or lower employing liquid nitrogen, the bright field image was observed by a factor of 5,000 to 40,000 and the image was recorded on a film, employing the aforementioned transmission type electron microscope. From this image, the thickness was determined for 300 grains using an image processor LUZEX III (produced by Nicolet Co.), and the average value thereof was determined.

Exposure, development and evaluation were carried out in a similar manner to Example 1.

TABLE 3

| Sample | Photosensitive Emulsified Dispersion | Silver aliphatic carboxylate: Grain size (μm) | Silver aliphatic carboxylate: Grain thickness (μm) | Photo sensitive layer: Binder | Photo sensitive layer: Tr* | Fog | Relative sensitivity | Maximum density | Fog: density variation rate (%) | Image lasting quality (%) | Aging stability (%) | Remark |
|---|---|---|---|---|---|---|---|---|---|---|---|---|
| 101 | A | 0.82 | 0.08 | Comp −1 | 43 | 0.240 | 100 | 100 | 54 | 78 | 84 | Comp. |
| 102 | A | 0.82 | 0.08 | P-2 | 54 | 0.235 | 98 | 102 | 38 | 79 | 85 | Comp. |
| 201 | D | 0.77 | 0.06 | Comp −1 | 44 | 0.241 | 103 | 98 | 32 | 78 | 82 | Comp. |
| 202 | D | 0.77 | 0.06 | p-2 | 54 | 0.224 | 120 | 118 | 23 | 98 | 99 | Inv. |
| 203 | E | 0.34 | 0.03 | p-2 | 54 | 0.210 | 125 | 125 | 22 | 99 | 98 | Inv. |

TABLE 3-continued

| Sample | Photosensitive Emulsified Dispersion | Silver aliphatic carboxylate Grain size (μm) | Silver aliphatic carboxylate Grain thickness (μm) | Photo sensitive layer Binder | Photo sensitive layer Tr* | Fog | Relative sensitivity | Maximum density | Fog density variation rate (%) | Image lasting quality (%) | Aging stability (%) | Remark |
|---|---|---|---|---|---|---|---|---|---|---|---|---|
| 204 | E | 0.34 | 0.03 | p-5 | 49 | 0.212 | 122 | 123 | 21 | 99 | 98 | Inv. |
| 205 | E | 0.34 | 0.03 | p-6 | 55 | 0.209 | 127 | 127 | 18 | 98 | 96 | Inv. |
| 206 | F | 0.42 | 0.03 | p-2 | 53 | 0.205 | 128 | 127 | 20 | 98 | 97 | Inv. |
| 207 | G | 0.46 | 0.04 | p-2 | 54 | 0.208 | 128 | 126 | 17 | 98 | 96 | Inv. |
| 208 | H | 0.48 | 0.04 | p-2 | 54 | 0.208 | 110 | 115 | 19 | 99 | 97 | Inv. |

*Thermal transition point (° C.)

As is apparent from Table 3, silver salt photothermographic dry imaging material samples according to the invention exhibited low fog and high sensitivity as well as superior image lasing quality and aging stability, compared to the comparative samples. It was further proved that the inventive samples exhibited a hue angle value of more than 180° and less than 270°, resulting in a blue black tone image, which is a suitable output as diagnostic images.

Example 3

The sample was prepared according to a similar manner to Example 1, except that Additive Solution "c" described below was added.

Preparation of Additive Solution (c)

Silver Saving Agent H-38 of 5.0 g was dissolved in 45.0 g of MEK to prepare additive solution (c).

Preparation of Photosensitive Layer Coating Solution A1

While stirring under an inert gas atmosphere (comprising 97% nitrogen gas) and heating to 21° C., 390 μl of Antifoggant 1 (10% methanol solution) was added to photosensitive emulsified dispersion A (50 g) and 15.11 g of MEK, followed by stirring for 1 hour. Further, 494 μl of calcium bromide (10% methanol solution) was added and stirred for 20 minutes. Subsequently, after adding 167 ml of the stabilizer solution followed by stirring for 10 minutes, 1.32 g of the infrared sensitizing dye solution described above was added and stirred for one hour. Thereafter, the resulting mixture was cooled to 13° C. and stirred further for 30 minutes. While maintaining at 13° C., 13.31 g of polyvinylbutyral resin (B-79, produced by SORCIA Co.) was added and stirred for 30 minutes. Thereafter, 1.084 g of tetrachlorophthalic acid (being a 9.4 weight % MEK solution) was added and stirred for 15 minutes. Further while stirring, 12.43 g of Additive Solution "a", 1.6 ml of Desmodur N3300/aliphatic isocyanate, manufactured by Mobey Co. (being a 10% MEK solution), 4.27 g of Additive Solution "b" and 10.0 g of Additive Solution "c" were successively added and stirred, whereby Photosensitive Layer Coating Solution A1 was prepared.

Silver Saving Agent H-38

Preparation of Silver Salt Photothermographic Dry Imaging Material Sample 301>>

Sample 301 was prepared in a similar manner to Example 1, employing Photosensitive Layer Coating Solution A1 and the surface protective layer coating solution of Example 1.

Samples 302 to 312 were prepared in a similar manner to Sample 301, except that the photosensitive emulsified dispersion and binder in photosensitive layer coating solutions were replaced by those shown in Table 4.

Exposure, development and evaluation were carried out in a similar manner to Example 1.

TABLE 4

| Sample | Photosensitive Emulsified Dispersion | Photo sensitive layer Binder | Photo sensitive layer Tr* | Silver saving agent | Fog density | Relative sensitivity | Maximum density | Fog density variation rate (%) | Image lastomg stability (%) | Aging stability (%) | Remark |
|---|---|---|---|---|---|---|---|---|---|---|---|
| 301 | A | Comp. −1 | 43 | H-38 | 0.240 | 100 | 100 | 57 | 68 | 70 | Comp. |
| 302 | A | P-2 | 54 | H-38 | 0.235 | 98 | 102 | 37 | 71 | 75 | Comp. |
| 303 | B | Comp. −1 | 43 | H-38 | 0.230 | 103 | 98 | 41 | 69 | 76 | Comp. |
| 304 | B | p-2 | 54 | H-38 | 0.224 | 108 | 118 | 24 | 85 | 87 | Inv. |
| 305 | B | p-5 | 50 | H-38 | 0.220 | 109 | 115 | 26 | 88 | 85 | Inv. |
| 306 | B | p-6 | 55 | H-38 | 0.223 | 108 | 114 | 24 | 87 | 88 | Inv. |
| 307 | C | p-2 | 54 | H-38 | 0.209 | 110 | 113 | 18 | 85 | 85 | Inv. |
| 308 | D | Comp. −1 | 44 | H-38 | 0.241 | 103 | 98 | 45 | 87 | 83 | Comp. |
| 309 | D | p-2 | 54 | H-38 | 0.224 | 120 | 118 | 22 | 88 | 89 | Inv. |
| 310 | E | p-2 | 54 | H-38 | 0.210 | 125 | 129 | 25 | 85 | 88 | Inv. |
| 311 | F | p-2 | 53 | H-38 | 0.205 | 127 | 128 | 21 | 86 | 86 | Inv. |
| 312 | G | p-2 | 54 | H-38 | 0.208 | 131 | 129 | 18 | 84 | 84 | Inv. |
| 313 | H | p-2 | 54 | H-38 | 0.208 | 128 | 123 | 23 | 89 | 89 | Inv. |

*Thermal transition point (° C.)

As is apparent from Table 4, silver salt photothermographic dry imaging material samples according to the invention exhibited low fog and high sensitivity as well as superior image lasing quality and aging stability, compared to the comparative samples. It was further proved that the inventive samples exhibited a hue angle value of more than 180° and less than 270°, resulting in a blue black tone image, which is a suitable output as diagnostic images.

Example 4

Preparation of Photosensitive Silver Halide Emulsion (a)

Photosensitive silver halide emulsion (a) was prepared similarly to the preparation of Photosensitive Silver Halide Emulsion A described above, provided that the process, "240 ml of a sulfur sensitizer S-5 (0.5% methanol solution) was added to the above emulsion, 1/20 equimolar amount, based on the sensitizer, of an auric sensitizer Au-5 was further added and chemical sensitization was performed with stirring at 55° C. for 120 minutes", was exckuded.

Preparation of Photosensitive Silver Halide Emulsion (b)

Photosensitive silver halide emulsion (b) was prepared similarly to the preparation of photosensitive silver halide emulsion B described earlier, provided that the chemical sensitization process was excluded.

Using pPhotosensitive silver halide emulsions (a) and (b), photosensitive emulsified dispersions (a) and (b) were prepared in a similar manner to Example 1, respectively.

Preparation of Photosensitive Layer Coating Solution (a)

Photosensitive layer coating solution (a) was prepared in a similar manner to photosensitive layer coating solution A1, except that the foregoing photosensitive emulsified dispersion (a) described above was employed in place of photosensitive emulsified dispersion A.

Preparation of Silver Salt Photothermographic Dry Imaging Material Sample 401

Sample 401 was prepared by simultaneously coating three layers comprising two photosensitive layers and one protective layer, employing a commonly known extrusion type coater so that the silver coating amount of the photosensitive (upper) layer comprising photosensitive emulsified dispersion A and that of the photosensitive (under) layer comprising photosensitive emulsified dispersion (a) were 0.7 and 0.3 $g/m^2$, respectively and the dry film thickness of surface protective layer was 2.5 $\mu$m. Thereafter, the resulting coat was dried for 10 minutes, employing 50° C. hot air at a dew point of 10° C.

Samples 402 to 409 were prepared in a similar manner to Sample 401, except that photosensitive emulsion dispersions and binders in the photosensitive layer coating solutions were varied to ones described in Table 5.

Exposure, development and various evaluations were performed in a similar manner to Example 1.

As is apparent from Table 5, silver salt photothermographic dry imaging material samples according to the invention exhibited low fog and high sensitivity as well as superior image lasing quality and aging stability, compared to the comparative samples. It was further proved that the inventive samples exhibited a hue angle value of more than 180° and less than 270°, resulting in a blue black tone image, which is a suitable output as diagnostic images.

According to the present invention, there have been provided a silver salt photothermographic dry imaging material, which exhibits enhanced sensitivity, minimized fogging and superior raw stock stability as well as superior silver image lasting quality after heat development, and an image recording method using the same.

What is claimed is:

1. A silver salt photothermographic dry imaging material comprising a support having thereon a photosensitive layer comprising silver aliphatic carboxylate grains and photosensitive silver halide grains, a reducing agent for silver ions, a binder and a cross-linking agent, wherein the photothermographic material has a silver coverage of 1.0 to 1.7 $g/m^2$; the photosensitive silver halide grains have a mean grain size of 0.03 to 0.055 $\mu$m and a degree of grain size dispersity of not more than 30%; after the dry imaging material has been subjected to photothermographic processing at a temperature of 100 to 200° C. for 5 to 50 seconds, the photosensitive layer exhibits a thermal transition temperature of 46 to 200° C.

2. The silver salt photothermographic dry imaging material of claim 1, wherein the silver aliphatic carboxylate grains are formed in the presence of a compound capable of functioning as a crystal growth retarder or a dispersant for the silver aliphatic carboxylate grains.

3. The silver salt photothermographic dry imaging material of claim 1, wherein the binder exhibits a glass transition temperature (Tg) of 70 to 105° C.

4. The silver salt photothermographic dry imaging material of claim 2, wherein the compound capable of functioning as a crystal growth retarder or a dispersant is an alcohol having not more than 10 carbon atoms.

5. The silver salt photothermographic dry imaging material of claim 2, wherein the compound capable of functioning as a crystal growth retarder or a dispersant is a branched aliphatic carboxilic acid or an unsaturated aliphatic carboxilic acid.

6. The silver salt photothermographic dry imaging material of claim 2, wherein the compound capable of functioning as a crystal growth retarder or a dispersant is gelatin or polyvinyl alcohol.

7. The silver salt photothermographic dry imaging material of claim 1, wherein a silver saving agent is incorporated in the photosensitive layer or a non-photosensitive layer.

TABLE 5

| Sample | Photosensitive emulsion dispersion (upper-layer /under-layer) | Photosensitive layer binder (upper-layer /under-layer) | Fog | Relative sensitivity | Maximum density | Fog density Variation ratio (%) | Image retention quality (%) | Storage stability (%) | Remark |
|---|---|---|---|---|---|---|---|---|---|
| 401 | A/a | Comp. 1/Comp. 1 | 0.240 | 100 | 100 | 57 | 68 | 70 | Comp. |
| 402 | A/a | P-2/p-2 | 0.235 | 98 | 98 | 37 | 71 | 75 | Comp. |
| 403 | B/b | P-2/p-2 | 0.215 | 122 | 118 | 18 | 98 | 95 | Inv. |
| 404 | C/b | P-2/p-2 | 0.219 | 126 | 117 | 17 | 95 | 94 | Inv. |
| 405 | D/b | P-2/p-2 | 0.215 | 130 | 120 | 15 | 94 | 95 | Inv. |
| 406 | E/b | P-2/p-2 | 0.213 | 132 | 122 | 15 | 96 | 96 | Inv. |
| 407 | F/b | P-2/p-2 | 0.209 | 128 | 123 | 16 | 97 | 98 | Inv. |
| 408 | G/b | P-2/p-2 | 0.211 | 127 | 119 | 14 | 98 | 99 | Inv. |
| 409 | H/b | P-2/p-2 | 0.212 | 125 | 109 | 15 | 94 | 92 | Inv. |

8. The silver salt photothermographic dry imaging material of claim 1, wherein the photosensitive layer comprises at least two layers.

9. The silver salt photothermographic dry imaging material of claim 1, wherein the photothermographic material, after subjected to thermal development, has a hue angle $h_{ab}$ of $180° < h_{ab} < 270°$.

10. An image recording method of the silver salt photothermographic dry imaging material of claim 1, which comprises the steps of:

(a) exposing the photothermographic material with a laser light scanning exposure apparatus, in which a scanning laser light is a longitudinal multiple mode;

(b) bringing the laser exposed photothermographic material into proximity with a heat source;

(c) thermally developing the laser exposed photothermographic material; and (d) removing the thermally developed photothermographic material from the heat source.

11. A silver salt photothermographic dry imaging material comprising a support having thereon a photosensitive layer comprising silver aliphatic carboxylate grains and photosensitive silver halide grains, a reducing agent for silver ions, a binder and a cross-linking agent, wherein the photothermographic material has a silver coverage of 1.0 to 1.7 $g/m^2$; the silver aliphatic carboxylate grains have a mean equivalent circle diameter of 0.05 to 0.8 $\mu$m and a mean grain thickness of 0.005 to 0.07 $\mu$m; and the photosensitive layer, after being subjected to photothermographic processing at a temperature of 100 to 200° C. for 5 to 50 seconds, exhibits a thermal transition temperature of from 46 to 200° C.

* * * * *